US006443555B1

(12) United States Patent
Silverbrook et al.

(10) Patent No.: US 6,443,555 B1
(45) **Date of Patent: *Sep. 3, 2002**

(54) PAGEWIDTH WIDE FORMAT PRINTER

(75) Inventors: Kia Silverbrook, Balmain; Tobin Allen King, Cremorne, both of (AU)

(73) Assignee: Silverbrook Research Pty Ltd, Balmain (AU)

( * ) Notice: Subject to any disclaimer, the term of this patent is extended or adjusted under 35 U.S.C. 154(b) by 0 days.

This patent is subject to a terminal disclaimer.

(21) Appl. No.: 09/526,504

(22) Filed: Mar. 16, 2000

(30) Foreign Application Priority Data

Mar. 16, 1999 (AU) ..... PP9222

(51) Int. Cl.[7] ..... B41J 2/155
(52) U.S. Cl. ..... 347/42; 347/13
(58) Field of Search ..... 347/12, 13, 40, 347/42

(56) References Cited

U.S. PATENT DOCUMENTS

| | | | | | |
|---|---|---|---|---|---|
| 4,706,130 | A | * | 11/1987 | Yamakawa | 358/296 |
| 5,107,276 | A | * | 4/1992 | Kneezel et al. | 347/42 |
| 5,160,945 | A | * | 11/1992 | Drake | 347/42 |
| 5,412,410 | A | * | 5/1995 | Rezanka | 347/42 |
| 5,719,602 | A | | 2/1998 | Hackleman et al. | |
| 6,312,114 | B1 | * | 11/2001 | Silverbrook | 347/85 |

* cited by examiner

*Primary Examiner*—Lamson D. Nguyen

(57) ABSTRACT

A pagewidth inkjet printer including:

a printhead assembly having an elongate pagewidth array of inkjet nozzles, chambers and thermal bend actuators formed using MEMS techniques;

wherein the array extends at least 36 inches (914 mm) in length; and, the printhead assembly being constructed and arranged such that adequate heat dissipation occurs at equilibrium operating conditions without a forced heat exchange system.

4 Claims, 27 Drawing Sheets

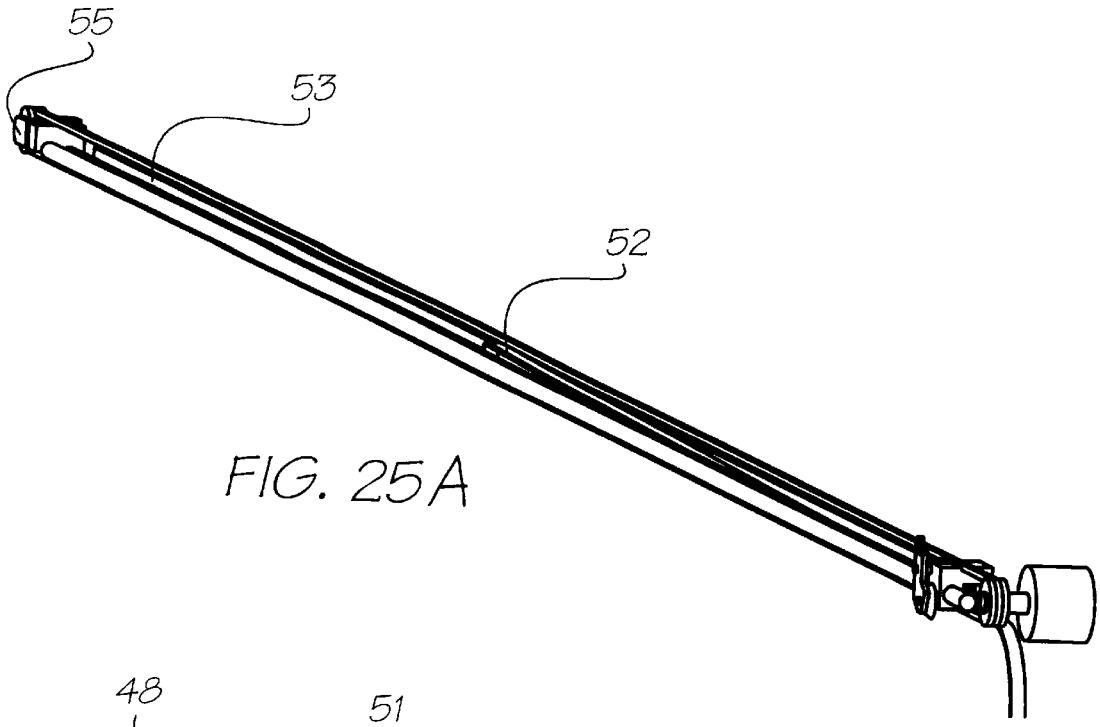
FIG. 25A
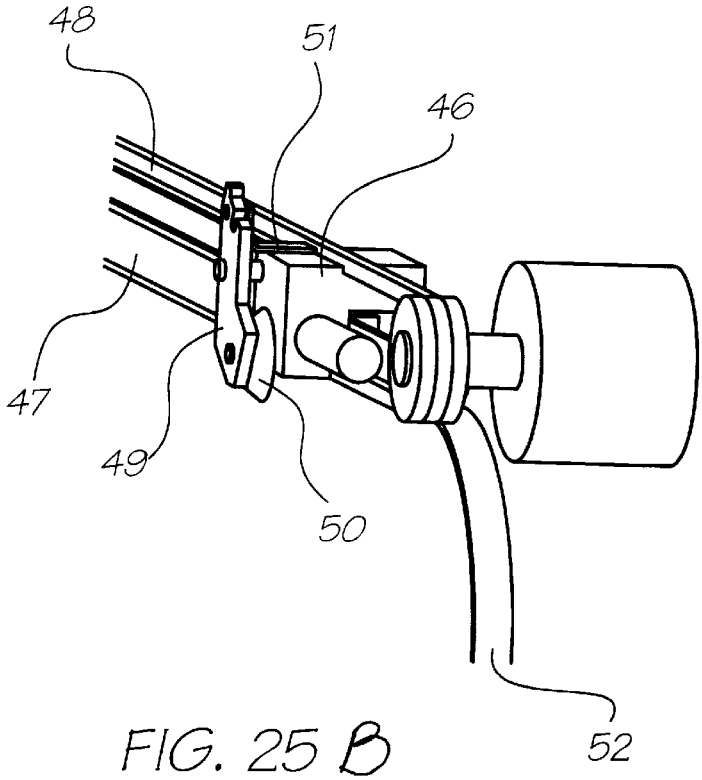
FIG. 25 B
FIG. 25

PAGEWIDTH WIDE FORMAT PRINTER

FIELD OF THE INVENTION

The present invention relates to printers and in particular digital inkjet printers for wide format printing.

BACKGROUND OF THE INVENTION

Wide format pagewidth printers are well known with various models commercially available, for example, the HP 3500CP printer from Hewlett-Packard.

Unfortunately, this printer and other similar wide format printers are excessively slow as the printhead prints in a series of transverse swathes across the page.

To overcome this, there have been attempts to design printers that can print the entire width of the page simultaneously. A pagewidth printhead does not traverse back and forth across the page and thereby significantly increases printing speeds. However, proposals for a pagewidth printhead assembly have not become commercially successful because of the functional limitations imposed by standard printhead technology. A 600 dpi thermal bubble jet printhead configured to extend the entire width of a 54 inch wide standard roll of paper would require 136,000 inkjet nozzles and would generate 24 kilowatts of heat during operation. This is roughly equivalent to the heat produced by 24 domestic bar heaters and would need to be actively cooled using a heat exchange system such as forced air or water cooling. This is impractical for most domestic and commercial environments as the cooling system for the printer would probably require some type of external venting. Without external venting, the room in which the printer is situated is likely to get over heated.

The power consumption problem also influences the size of the printhead required for pagewidth wide format printing. The distance between thermal inkjet nozzles cannot be less than a minimum spacing in case the heat generated to fire ink from one nozzle inadvertently fires the ink from an adjacent nozzle. A similar problem applies to piezo-electric inkjet printheads. The piezo-electric material has a small size change per volt applied; typically about $3\times10^{-6}$ m per volt. Even if this size change is optimised using a bend actuator mechanism, the physical dimensions of the piezo-electric material required to produce the size change necessary to eject ink from a nozzle will only allow a printhead construction with one nozzle per 1 to 4 $mm^2$.

In light of the low nozzle packing densities permitted by the standard inkjet technologies, the size of the printhead required for full color wide format pagewidth printing becomes impractical.

Another obstacle to the commercial manufacturer of pagewidth printheads is the cost. These printheads are formed using Micro-Electro-Mechanical Systems (MEMS) techniques that are similar to the manufacture of silicon computer chips. In this process, the ink nozzles and ejector mechanisms are formed in a series of etching and deposition procedures on silicon wafers as is the case with other computer chips.

The cost of printhead chips is roughly proportional to the area of the wafer required, however, the cost of the printhead does increase disproportionately with an increasing area of wafer used. This is because manufacturing costs begins to escalate as the chip defect rate also increases with wafer size. Faults will inevitably occur during silicon chip manufacture and some level of attrition is always present because of this. A single chip will render an entire pagewidth printhead chip defective as is the case with regular silicon chip production. However, because the pagewidth chip is larger than regular chips, there is a higher probability that any particular chip will be defective thereby raising the defect rate as a whole in comparison to regular silicon chip production. The problem is further exacerbated when much larger pagewidth chips are manufactured for wide format printing.

SUMMARY OF THE INVENTION

According to a first aspect, the present invention provides a pagewidth inkjet printer including:

a printhead assembly having an elongate pagewidth array of inkjet nozzles, chambers and thermal bend actuators formed using MEMS techniques;

the printhead assembly being constructed and arranged such that adequate heat dissipation occurs at equilibrium operating conditions without the use of a forced heat exchanged system.

Preferably, the printhead assembly dissipates the majority of the heat produced during the operation of the inkjet nozzles, chambers and actuators is dissipated by the ink ejected from the nozzles. In a further preferred form, the printhead assembly has a plurality of inkjet printhead modules arranged end to end to form the array, each module having a printhead chip in which the nozzles, chambers and actuators are formed wherein the surface area of the chip required for each nozzle is less than 0.5 $mm^2$. In a particularly preferred form, the surface area of the chip required for each nozzle is less than 0.1 $mm^2$ and may conveniently be less than 0.02 $mm^2$.

According to a second aspect, the present invention provides a pagewidth inkjet printer including:

a printhead assembly having an elongate pagewidth array of inkjet nozzles, chambers and thermal bend actuators formed using MEMS techniques;

wherein the array extends at least 36 inches (914 mm) in length; and, the nozzles, chambers and actuators are formed in one or more printhead chips such that the surface area of the chip required for each nozzle is less than 0.5 $mm^2$.

According to another aspect, the present invention provides a pagewidth inkjet printer including:

a printhead assembly having an elongate pagewidth array of inkjet nozzles, chambers and thermal bend actuators formed using MEMS techniques;

wherein the array extends at least 36 inches (800 mm) in length; and, the printhead assembly has a plurality of inkjet printhead modules arranged end to end to form the array.

In a particularly preferred form, the printhead assembly further includes a plurality of printhead units, each unit having a plurality of the printhead modules mounted thereon such that the printhead units are in turn mounted to the printhead assembly to form the array. In some embodiments, 70 printhead modules are abutted in an overlapping format to provide a printhead assembly extending 54 inches (1372 mm). It will be appreciated that by overlapping adjacent printhead modules, the printing produced by each module can be electronically adjusted to precisely abut the printing from modules on either side.

It will be appreciated that by mounting a number of printhead modules on a printhead unit and then using a number of printhead units to form the printhead assembly, there are two levels of modularity in the design which permit defective components to be removed and replaced conveniently and relatively inexpensively.

It has been found that pagewidth printers incorporating printhead chips using thermal bend actuators can produce a high resolution print while consuming significantly less power. A 54 inch wide format pagewidth printhead formed in accordance with standard thermal inkjet technology would provide 136,000 inkjet nozzles to produce a resolution of 600 dpi. It could print 150 foot long roll of standard 54 inch wide paper in approximately 2.4 minutes, however, it will require 24 kilowatts of power of which approximately 20 kilowatts would need to be dissipated by forced air, water or other coolant.

A printer according to the present invention would also print the standard 150 foot length of a 54 inch wide roll in 2.4 minutes, however by using 364,000 nozzles it provides 1600 dpi resolution (generally accepted as photographic quality) and would consume only 0.655 kilowatts which would not require any additional cooling. With this level of power consumption, the ejection of ink would dissipate sufficient heat. This allows a greater nozzle packing density and reduces the overall size of the printhead assembly.

BRIEF DESCRIPTION OF THE DRAWINGS

Notwithstanding any other forms which may fall within the scope of the present invention, a preferred form denoted as the Macroprint product will now be described by way of example only with reference to the accompanying drawings in which:

FIG. 25*a* is a perspective view of the media cutter;

FIG. 25*b* is an enlarged portion of FIG. 25*a* showing the rotating knife wheel and motor of the media cutter;

REFERENCE NUMERALS IN DRAWINGS

Figure 1:
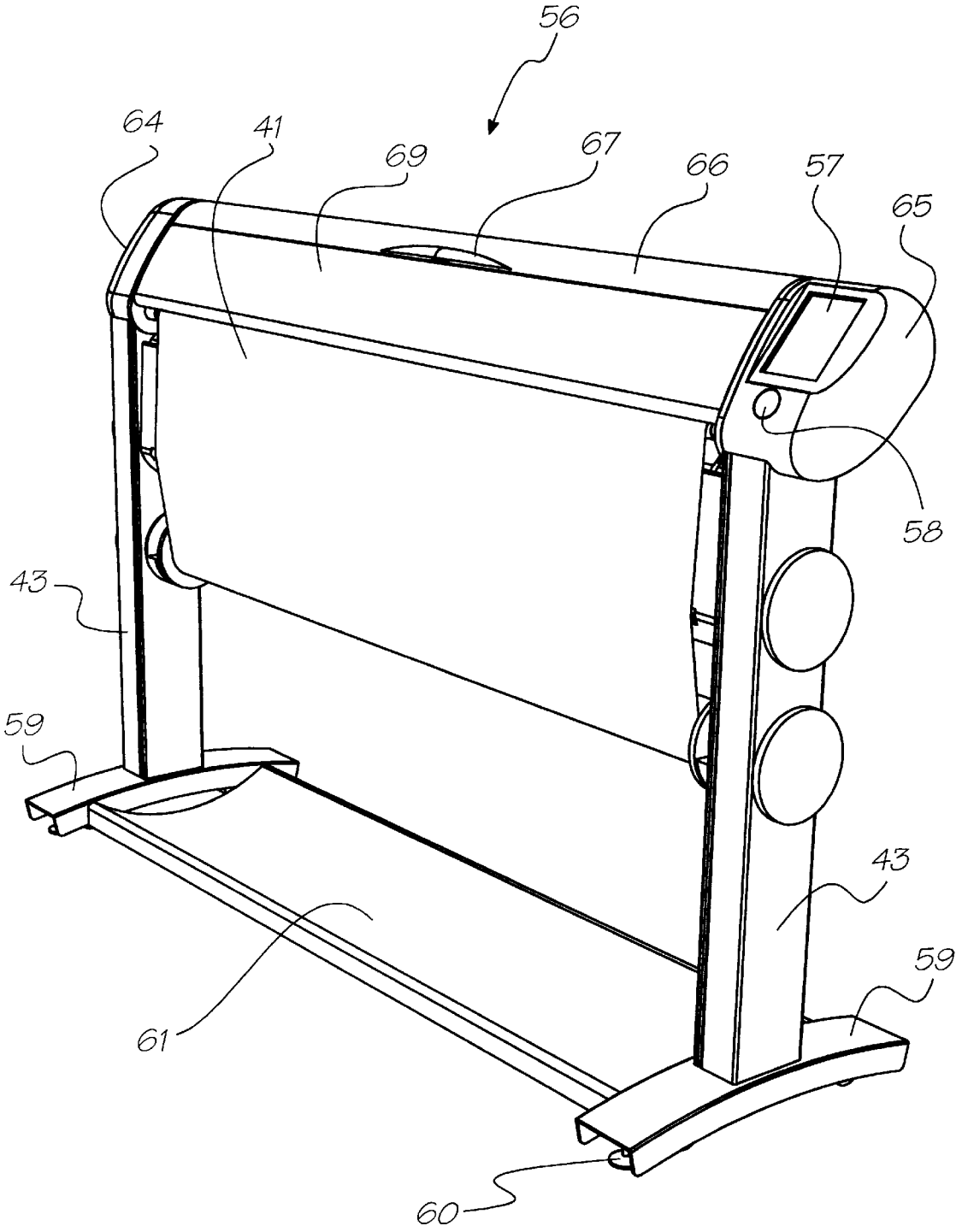
FIG. 1 is a front perspective view of the printer with media on the feed and take up spools.
Figure 2:
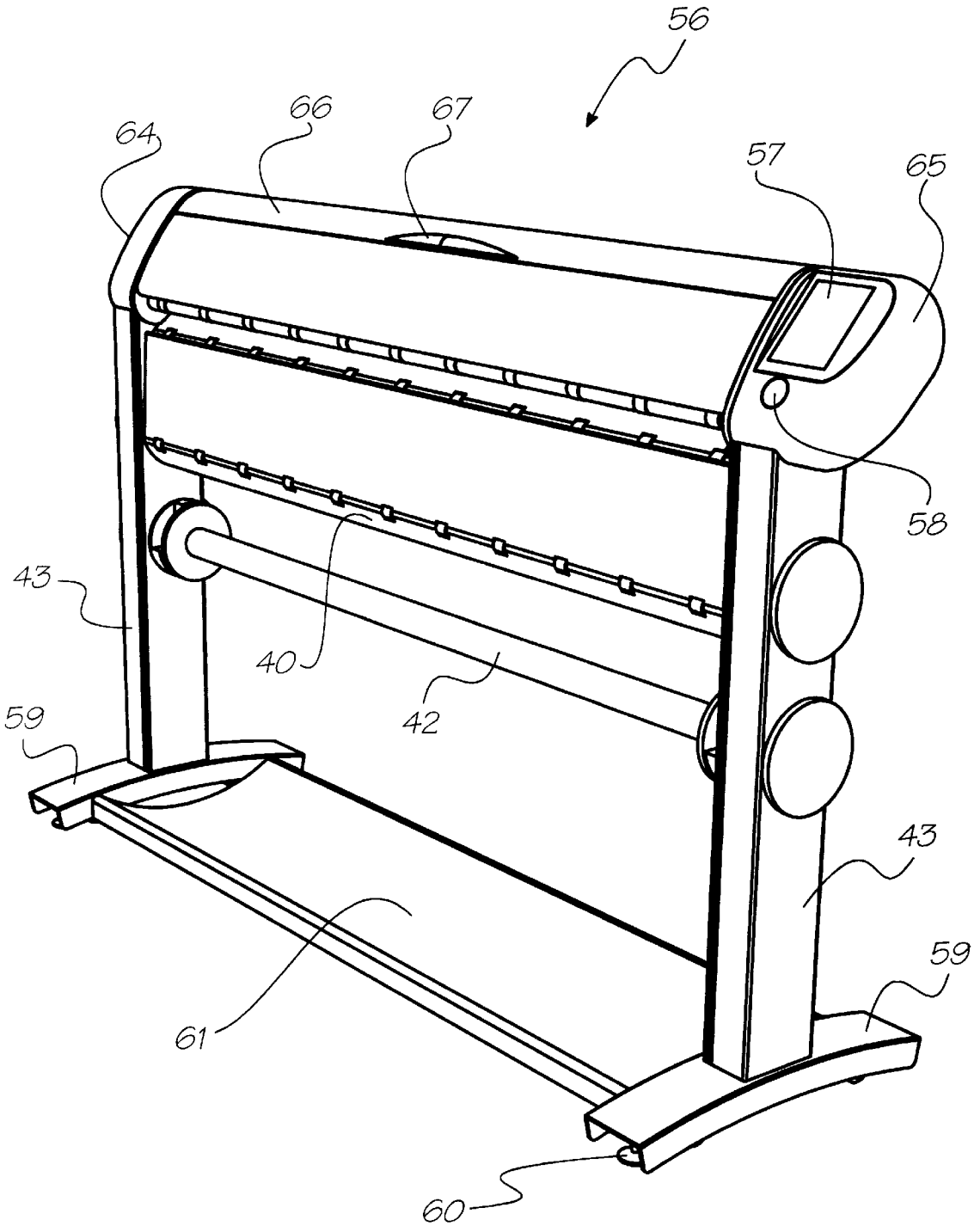
FIG. 2 is a front perspective view of the printer without media on the spools.
Figure 3:
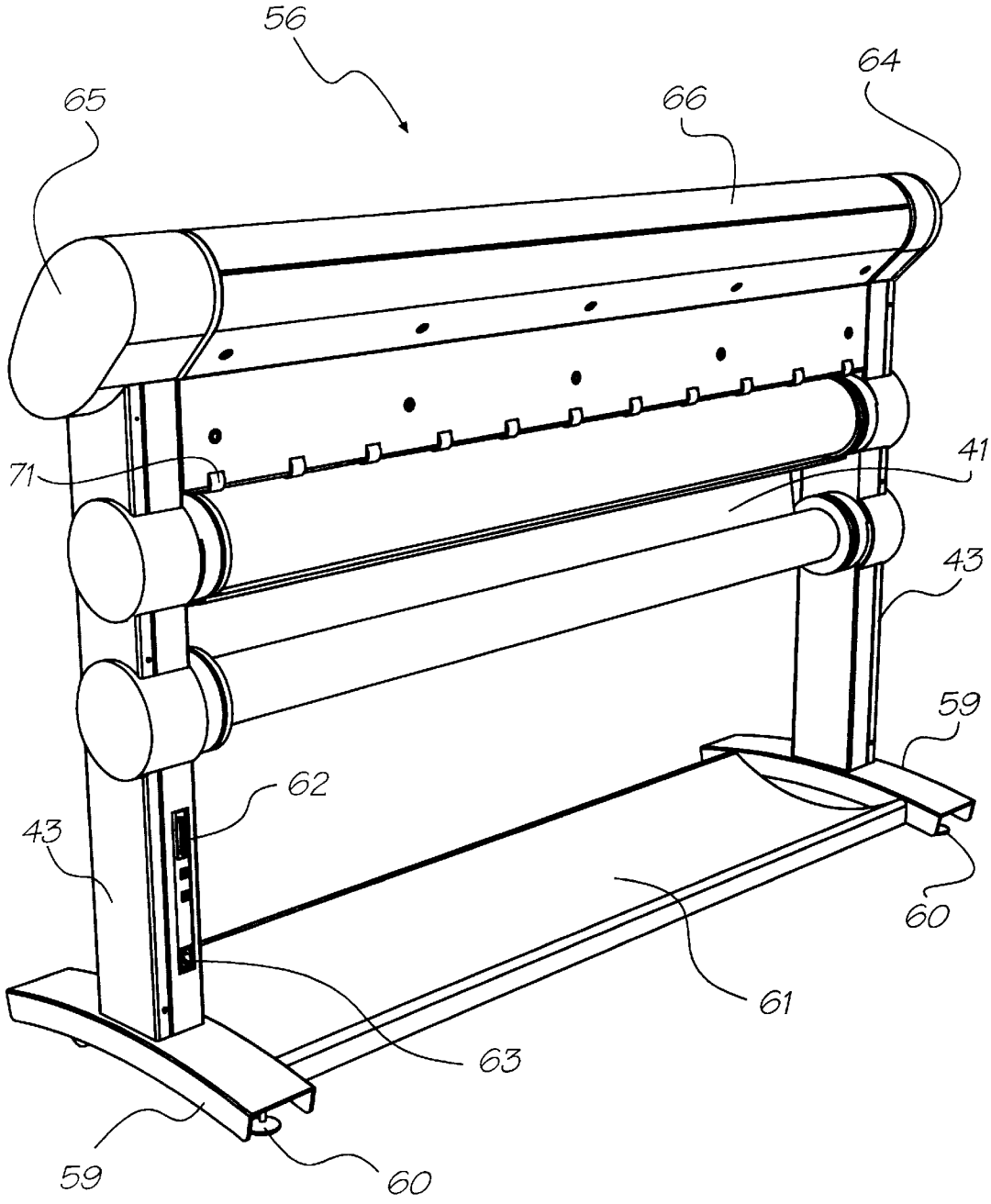
FIG. 3 shows a rear perspective view of the printer with media on the feed and take up spools.
Figure 4:
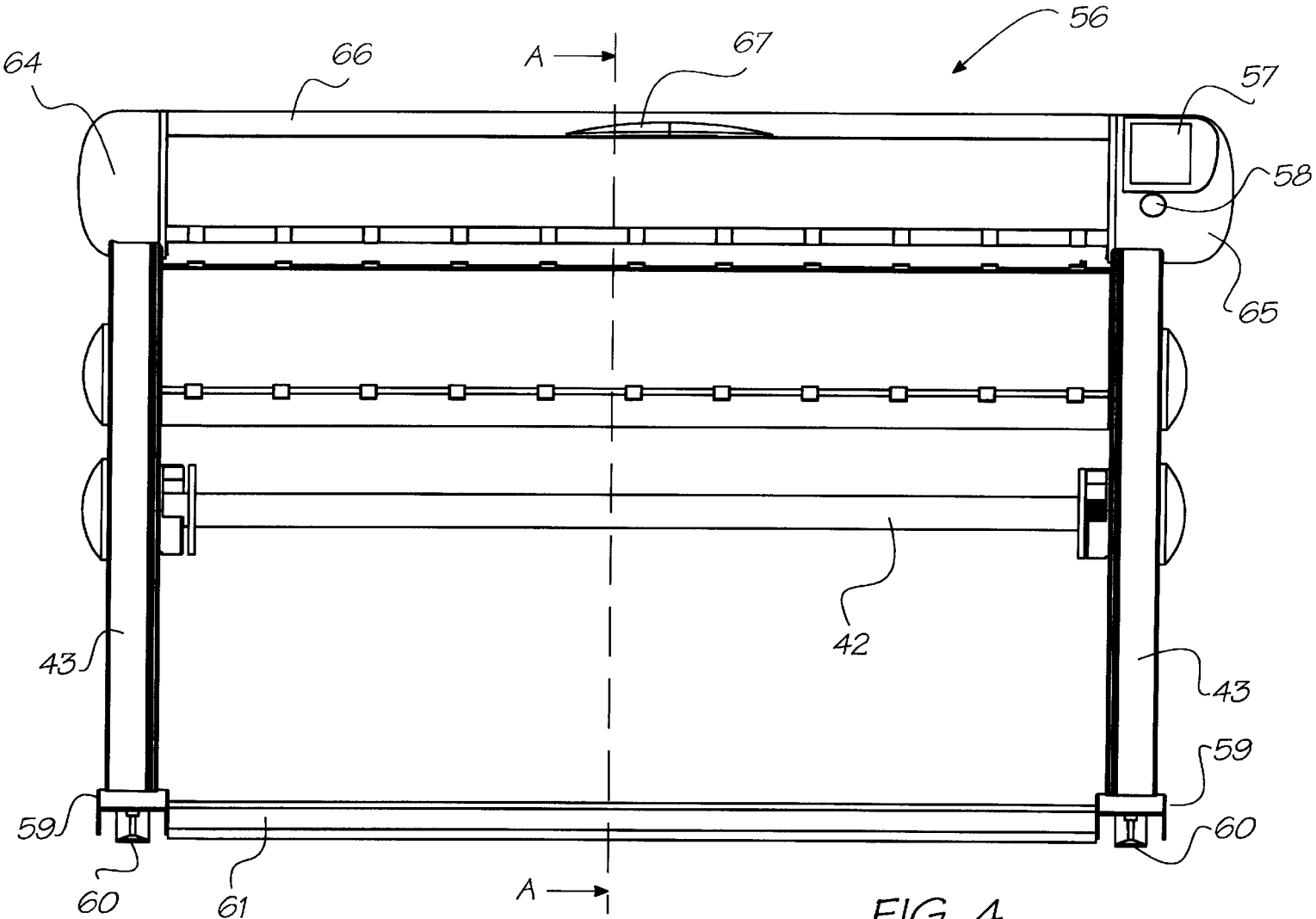
FIG. 4 is a front elevation of the printer without media on the feed or take up spools.
Figure 5:
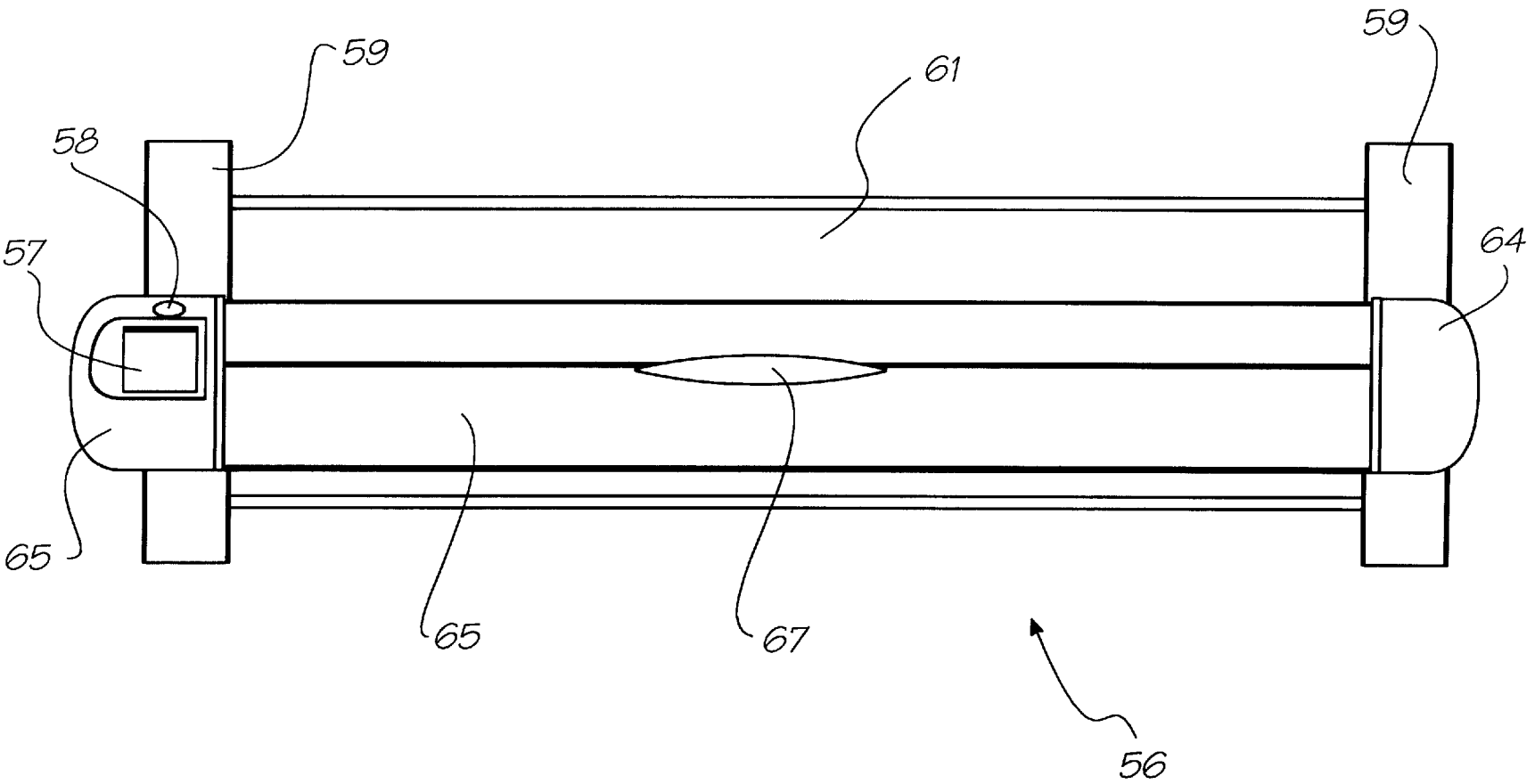
FIG. 5 is a plan view.
Figure 6:
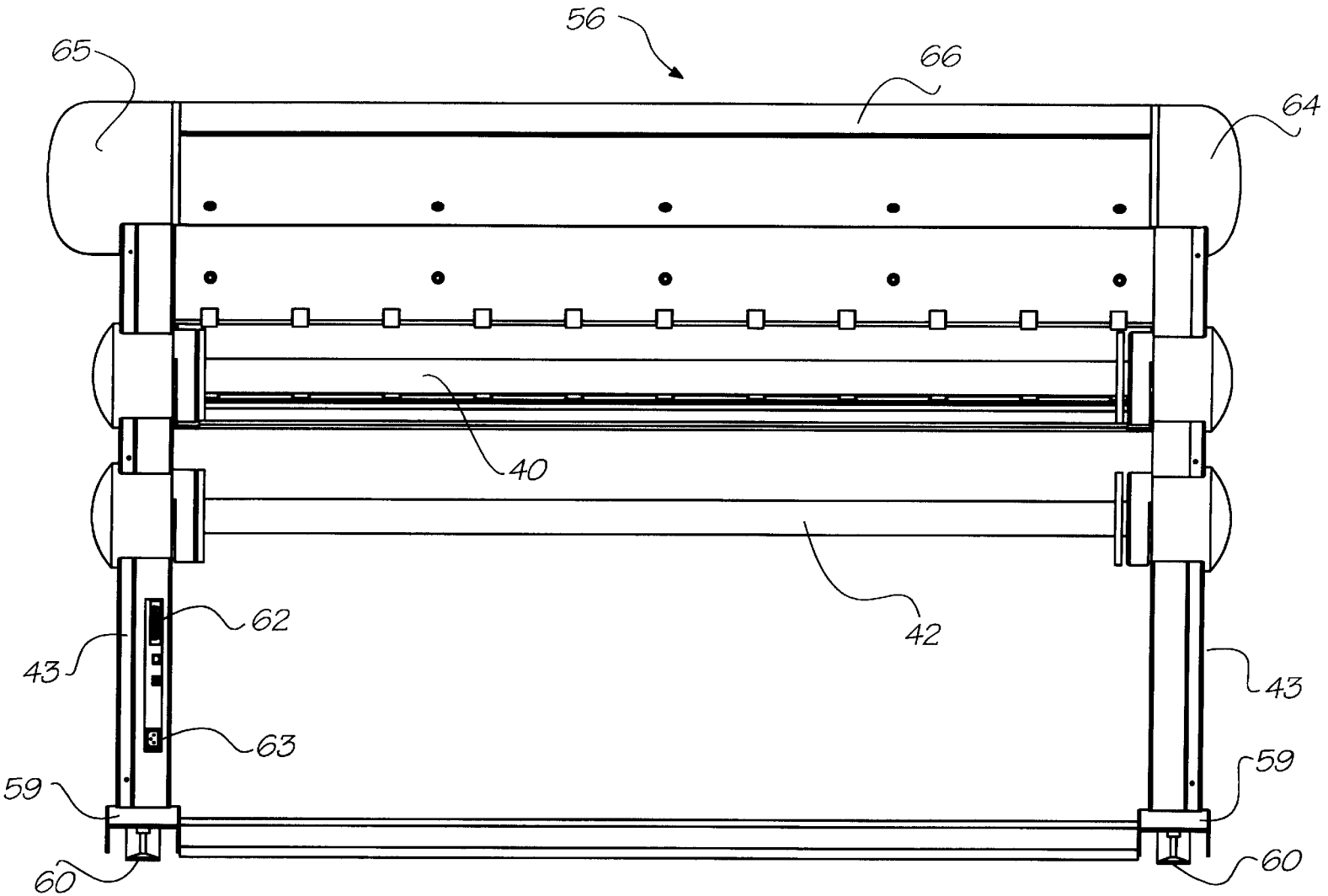
FIG. 6 is a rear elevation without media on the feed or take up spools.

1. printhead modules
2. printhead chip
3. printhead unit
4. ink connectors
5. metal nozzle shield
6. ink cartridges
7. sprung capping assembly
8. metal chassis
9. exit spike wheels
10. primary feed roller
11. media entry point
12. motor driven pinch rollers
13. secondary media feed roller
14. media exit point
15. PCB's
16. DRAM
17. USB2 connector
18. controller chip
19. ribbon cable
20. USB2 cables
21. main PCB
23. metal platen
24. powered cam shaft
25. motor and gearbox
26. ink reservoirs
27. reservoir sensors
28. ink cartridge exit nozzle
29. foil bladder
30. ink outlet molding
31. sprung rubber coated ball bearing
32. ink inlet assembly
33. sprung collar
34. hydrophobic seal
35. pin
36. ink
37. metal trough
38. retaining clips
39. retaining clip recesses
40. feed spool
41. media
42. take up spool
43. spaced legs
44. motor and gear box assemblies
45. brushes
46. traverser block and paper sensor
47. shaft
48. belt drive
49. pivoting arm

50. rotating knife wheel
51. metal spring
52. sensor leads
53. metal U channel
54. cheek molding
55. sprung tensioner device
56. main printer housing
57. color LCD and touch screen
58. emergency stop button
59. base structures
60. wind down feet
61. paper tray
62. date connectors
63. mains power input
64. left end molding
65. right end molding
66. lid
67. handle
68. busbars
69. front panel
70. castors
71. alternative media entry rollers

DESCRIPTION OF A PREFERRED EMBODIMENT

The preferred embodiment, known as Macroprint, is a wide format printer that prints 1600 dpi photographic quality prints up to 54 inches wide. Intended markets include photographic bureaus, CAD bureaus, advertising agencies, corporate and educational applications. The product accommodates standard media sizes and types from A4 sheets to rolls 54 inches wide by 150 feet in length. The main feature of Macroprint is its print speed: typically 600 times faster than comparable machines.

The product is simple in operation and has been designed with powder coated metal panels and standard extrusions to minimise expensive and complicated assemblies and numerous moldings. Referring to FIGS. 1 to 8, the main printer housing 56 is supported between spaced legs 43. An intuitive user interface on a LCD color touch screen 57 welcomes the user and initialises the machine from stand by mode. For the user's convenience, a large emergency stop button 58 is provided directly beneath the touch screen 57.

Figure 7:
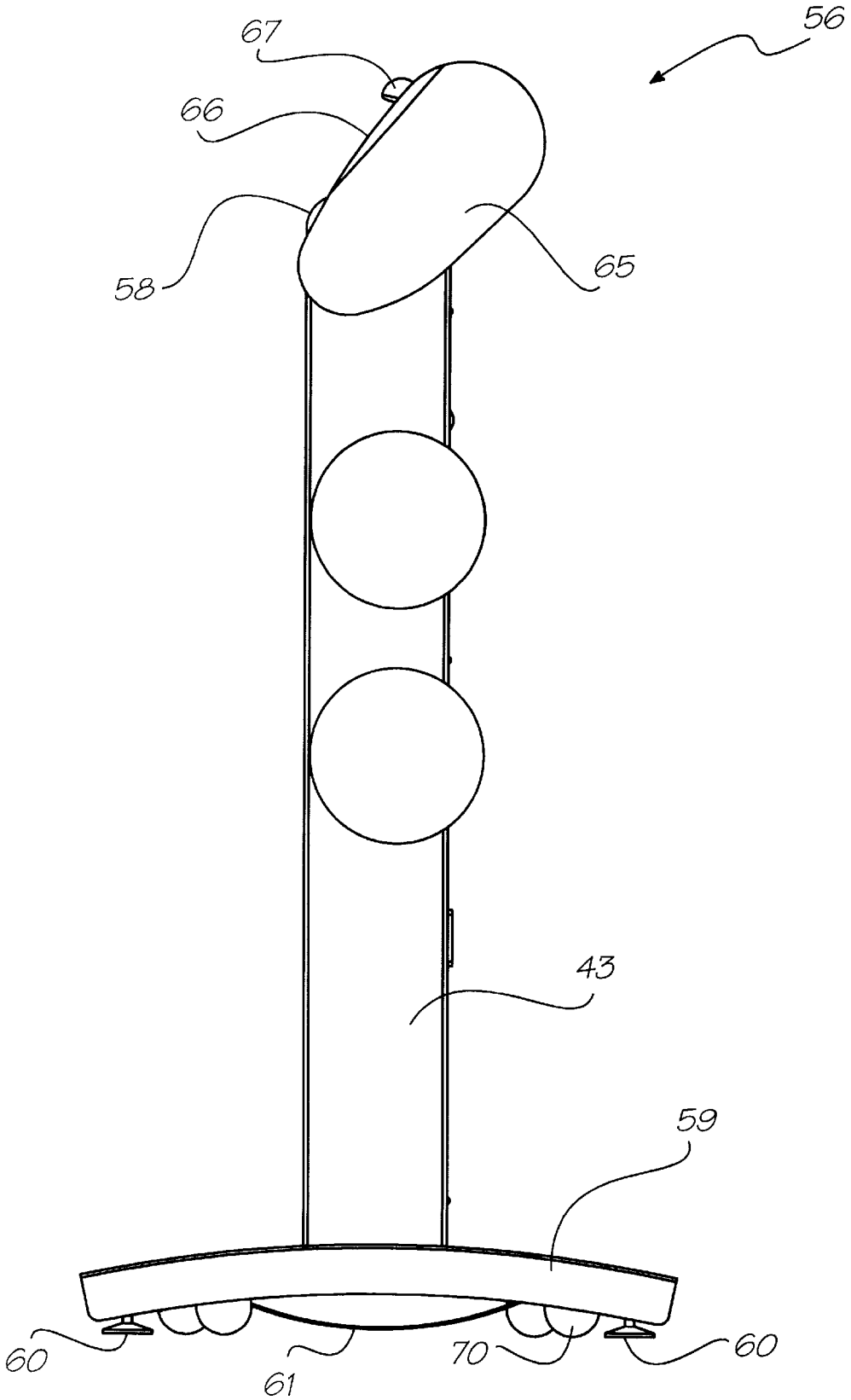
FIG. 7 is a right end elevation.
Figure 8:
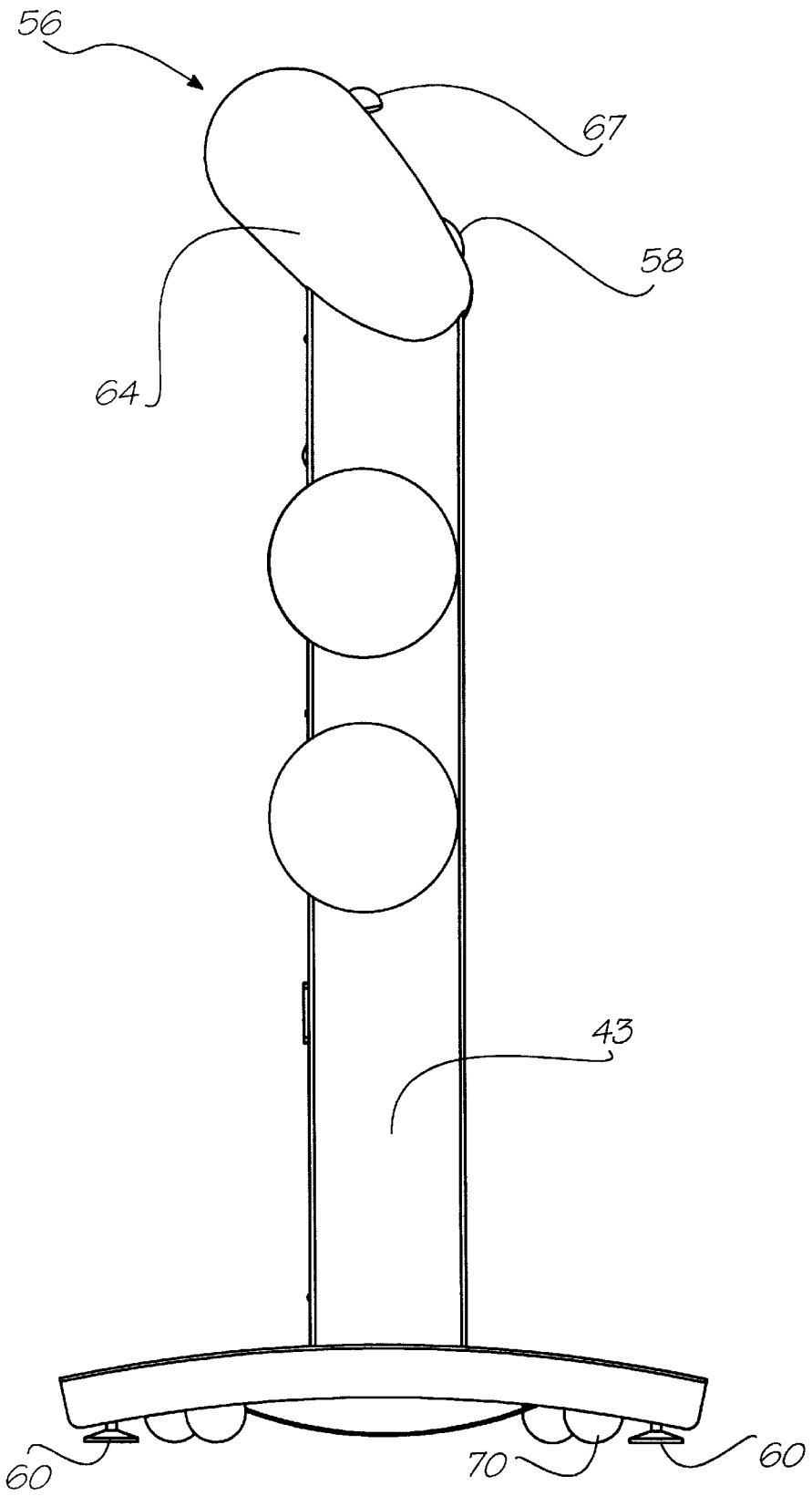
FIG. 8 is a left end elevation.

Referring to FIGS. 7 and 8, the legs 43 are secured to base structures 59 which include castors 70 for mobility and wind down feet 60 for stability. A paper tray 61 extends between the base structures 59 to collect single printed sheets.

Figure 9:
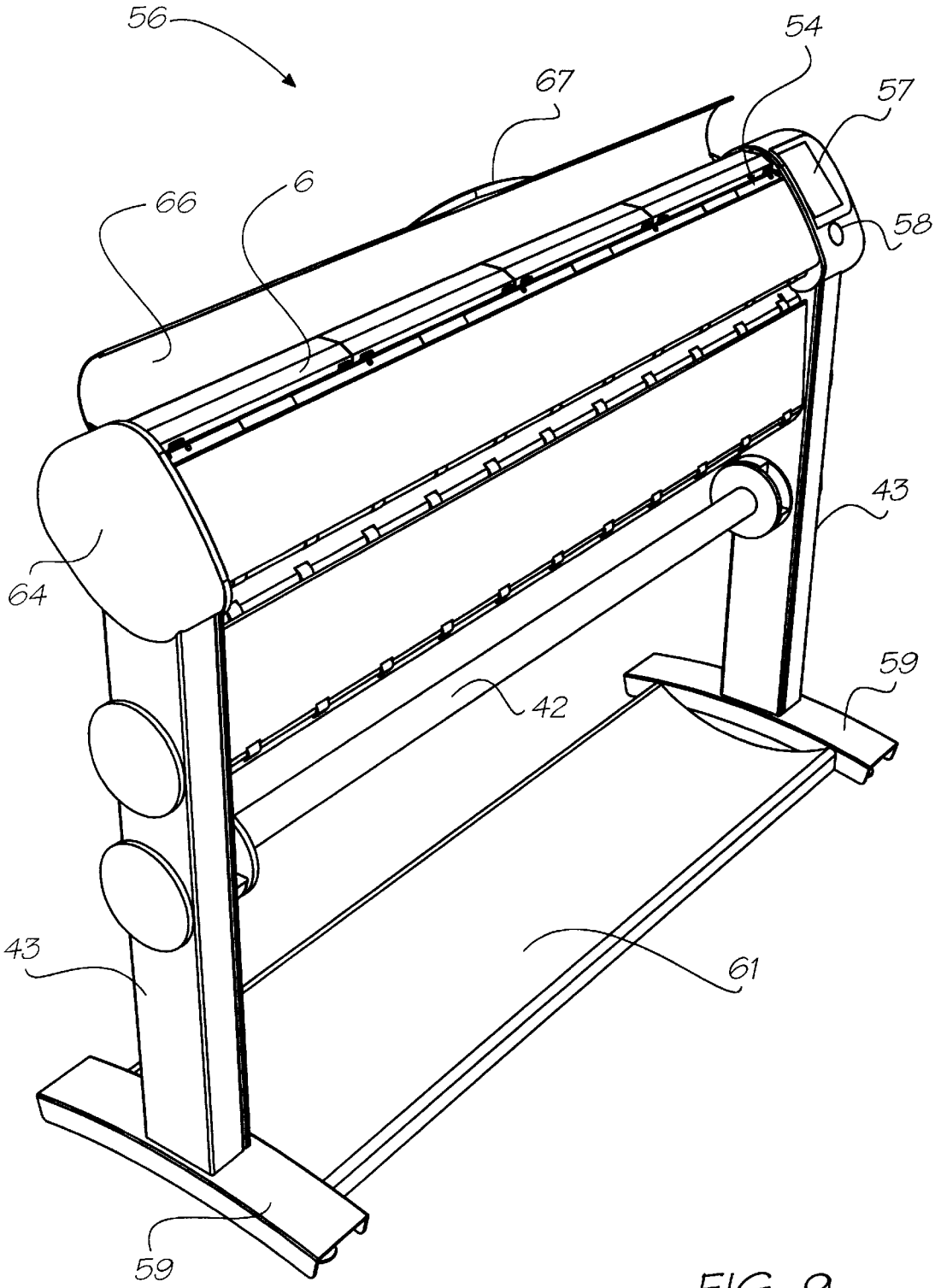
FIG. 9 is a front perspective view of the printer with the top lid open exposing the ink cartridges.
Figure 10:
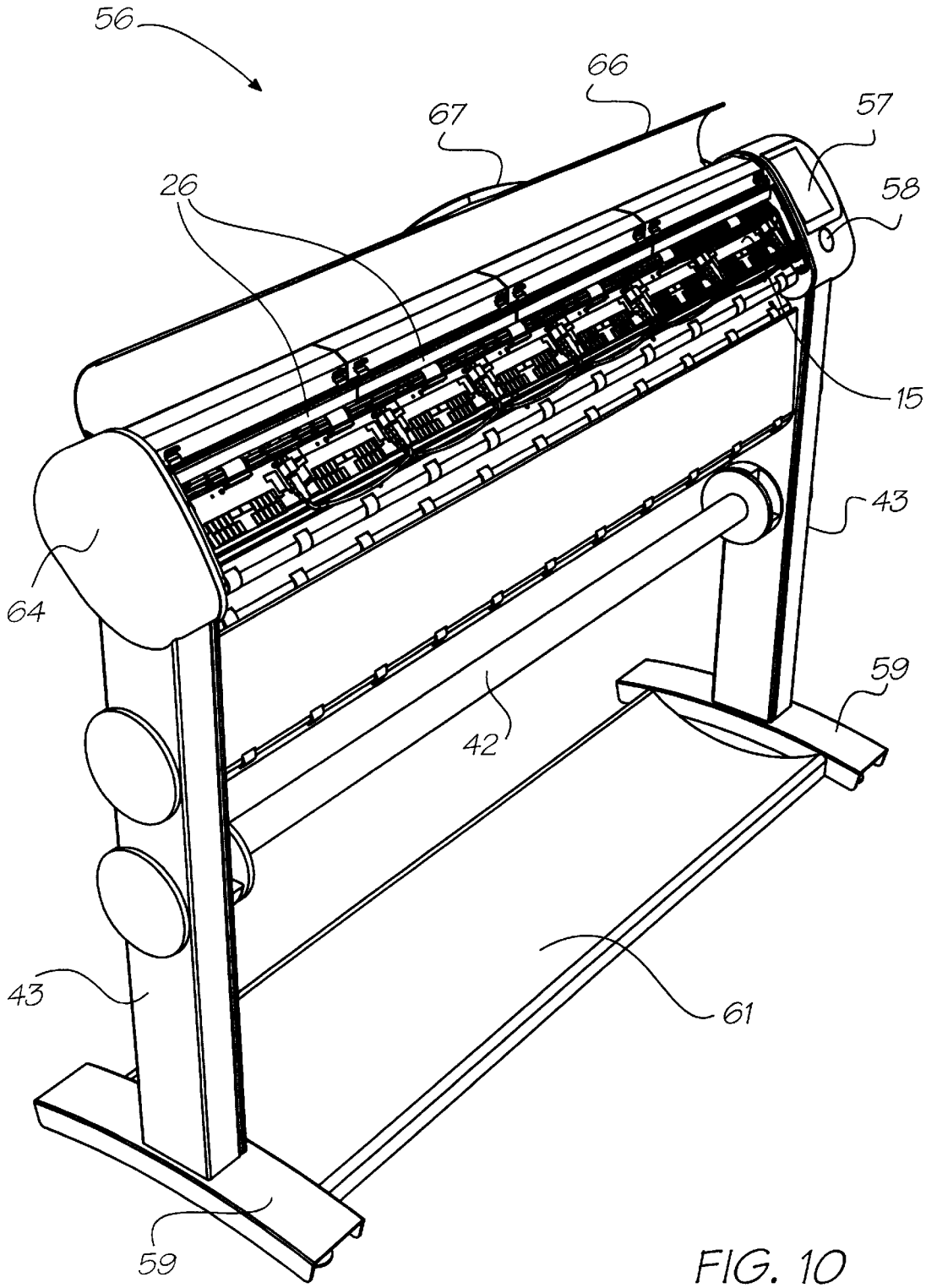
FIG. 10 is a front perspective view of the printer showing the front panel removed to expose the printhead units.
Figure 11:
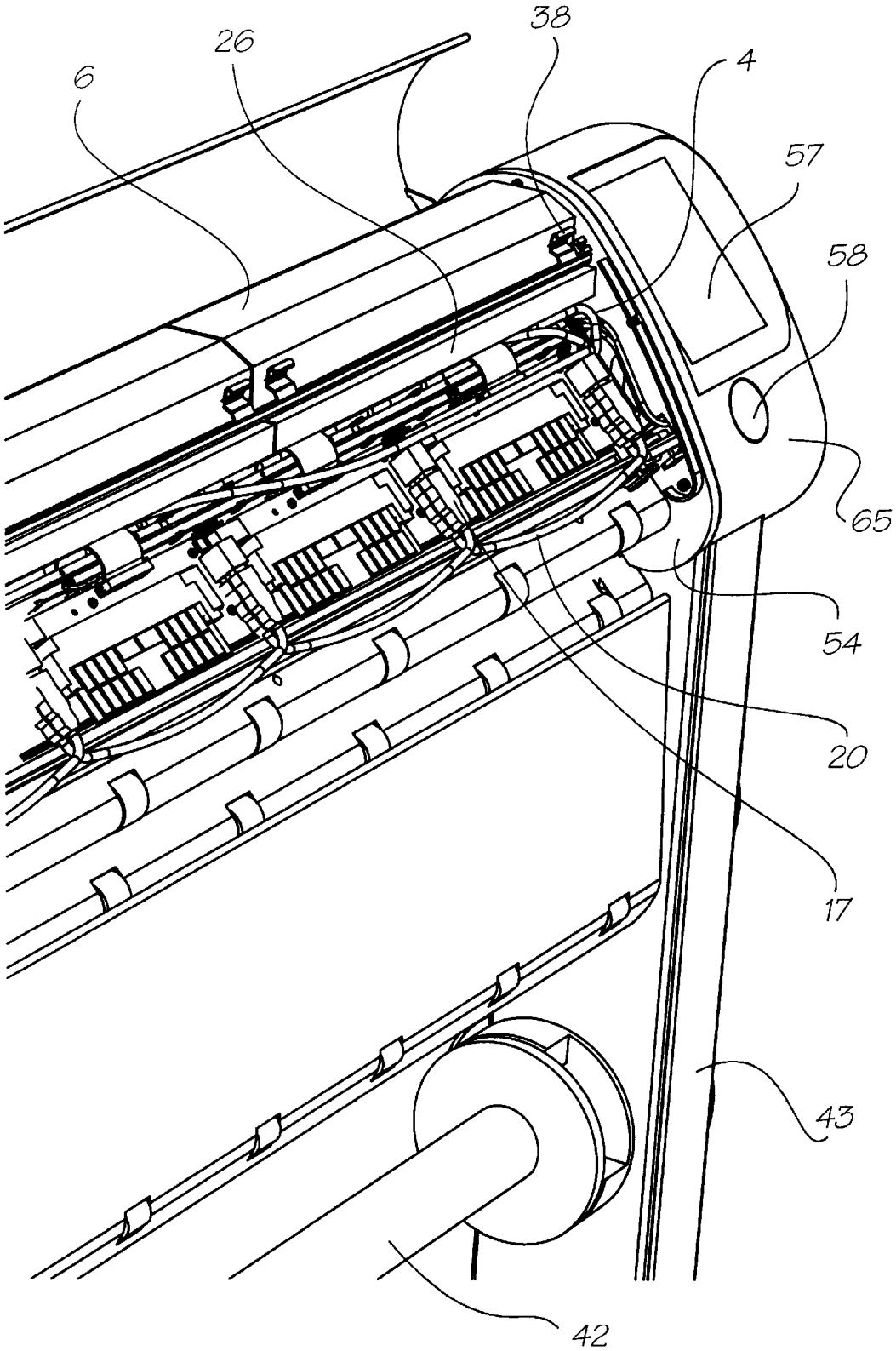
FIG. 11 is an enlarged portion of FIG. 10.

One of the legs 43 is provided with data connectors 62 and a mains power input 63. The legs 43 support the main printer housing 56 at left and right end moldings 64 and 65 respectively. The top of the printer housing includes a lid 66 which may be opened using handle 67 to replace ink cartridges 6 shown in FIG. 9. The front of the main housing 56 has a front panel 69 which may be removed to further expose the printhead assembly as shown in FIG. 10.

As best shown in FIGS. 15, 16, 17 and 18, Macroprint uses a full width array of 70 printhead modules 1 mounted end to end at a small angle to the media feed direction to potentially provide a slight overlap between the printing of adjacent modules. The printing from each module 1 is aligned after installation such that it precisely abuts the printing of adjacent modules. Each module 1 has a printhead chip 2 constructed using MEMS (Micro-Electro-Mechanical Systems) techniques to form the ink nozzles, chambers and actuators. The particular printhead chips used by Macroprint are called MEMJET chips. These chips are fully described in the Applicant's United States Application entitled "A Method of Manufacturing a Thermal Bend Actuator" Ser. No. 09/524,958, the contents of which are specifically incorporated by cross reference. Further, the construction of the preferred embodiment is along similar lines to that formed in Australian Provisional Patent Application No. PQ4559, filed Dec. 9, 1999, entitled "Memjet Four Color Modular Printhead Packaging", and Australian Provisional Patent Application No. PQ5959, filed Mar. 2, 2000, entitled "Modular Printhead". The contents of both these applications are also specifically incorporated by cross reference.

MEMJET chips have 5280 nozzles, each with its own mechanical ink droplet ejection mechanism. MEMJET chips using cyan, magenta, yellow and black (CMYK) ink provide a printhead with 1600 nozzles per inch for each color. This produces color printing at an image resolution of 1600 dpi which is sufficient for photographic image quality.

Figure 15:
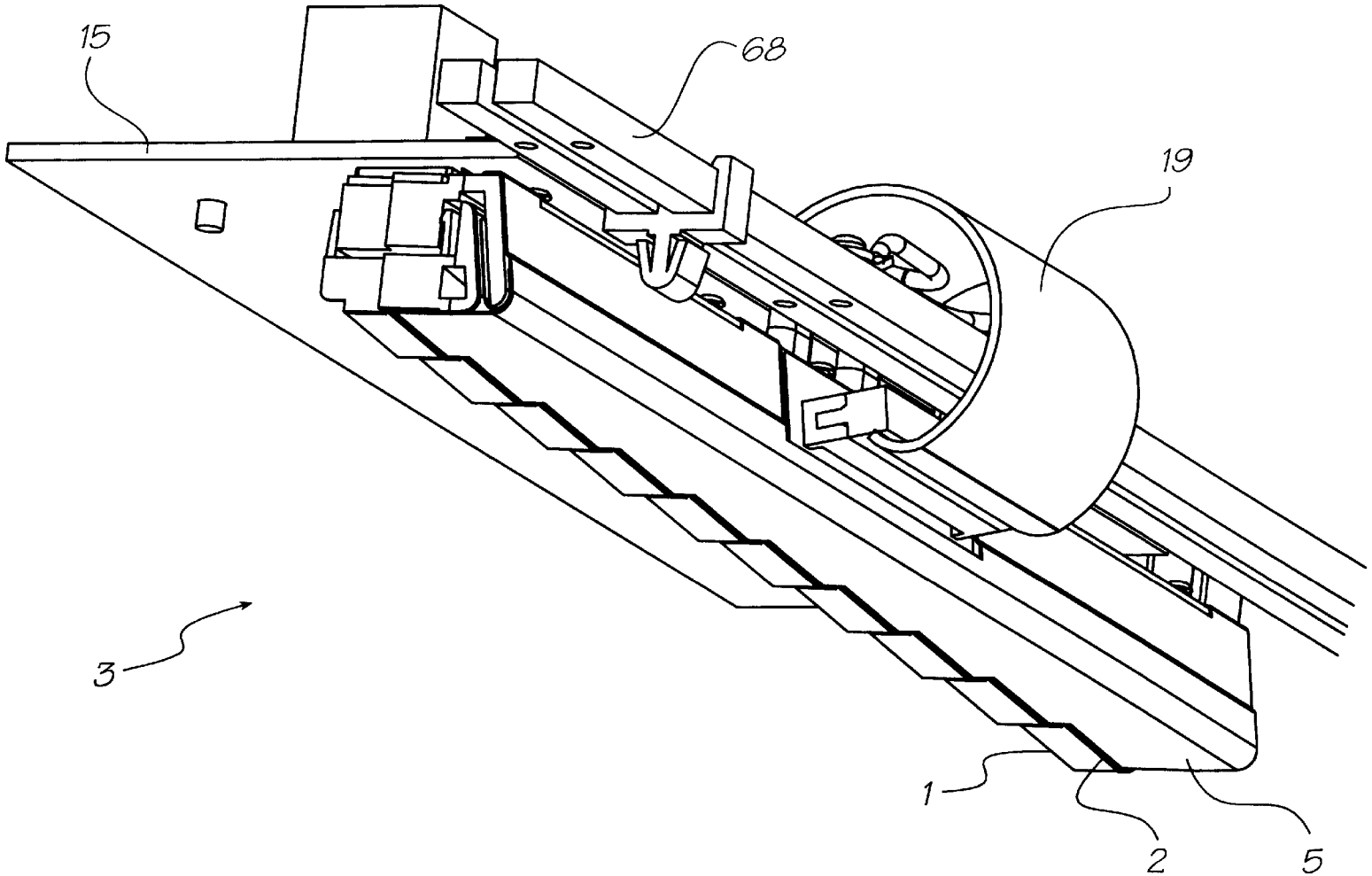
FIG. 15 is an underside perspective view of a single printhead unit in isolation with 10 attached printhead modules.
Figure 16:
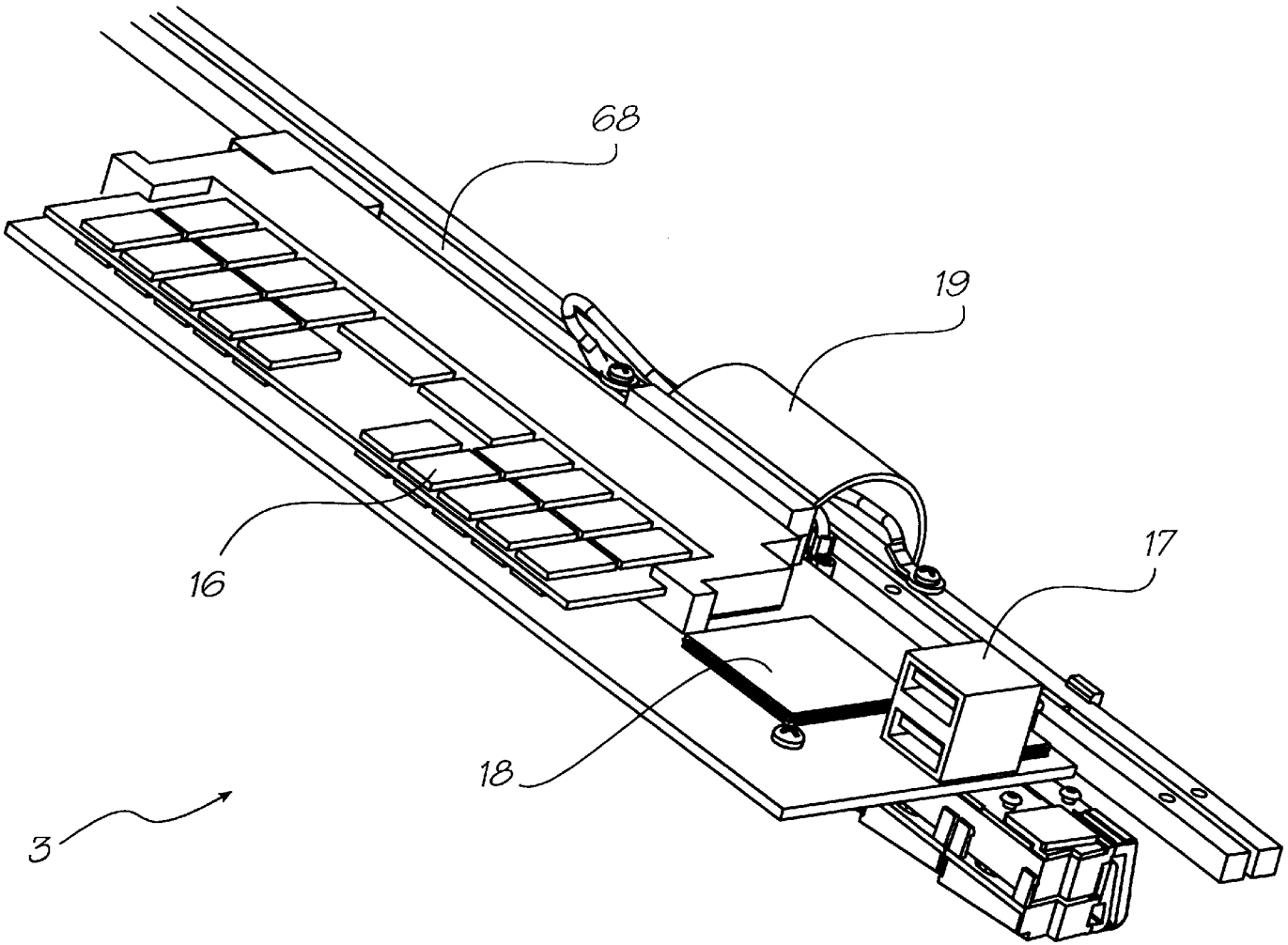
FIG. 16 is a top-side perspective view of a single printhead unit in isolation.
Figure 17:
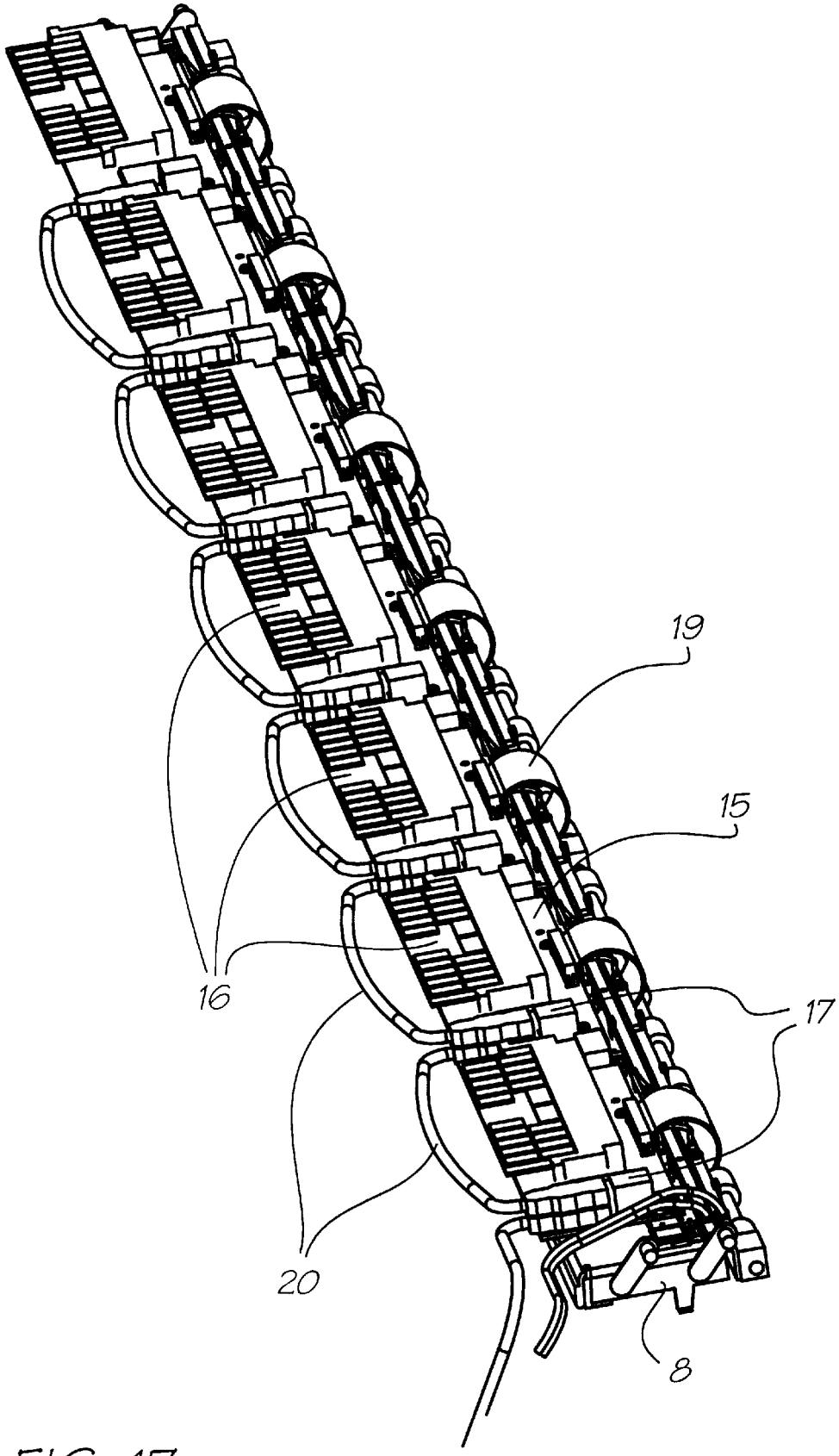
FIG. 17 is a perspective view of 7 printhead units mounted end to end on a floating support metalwork chassis.
Figure 18:
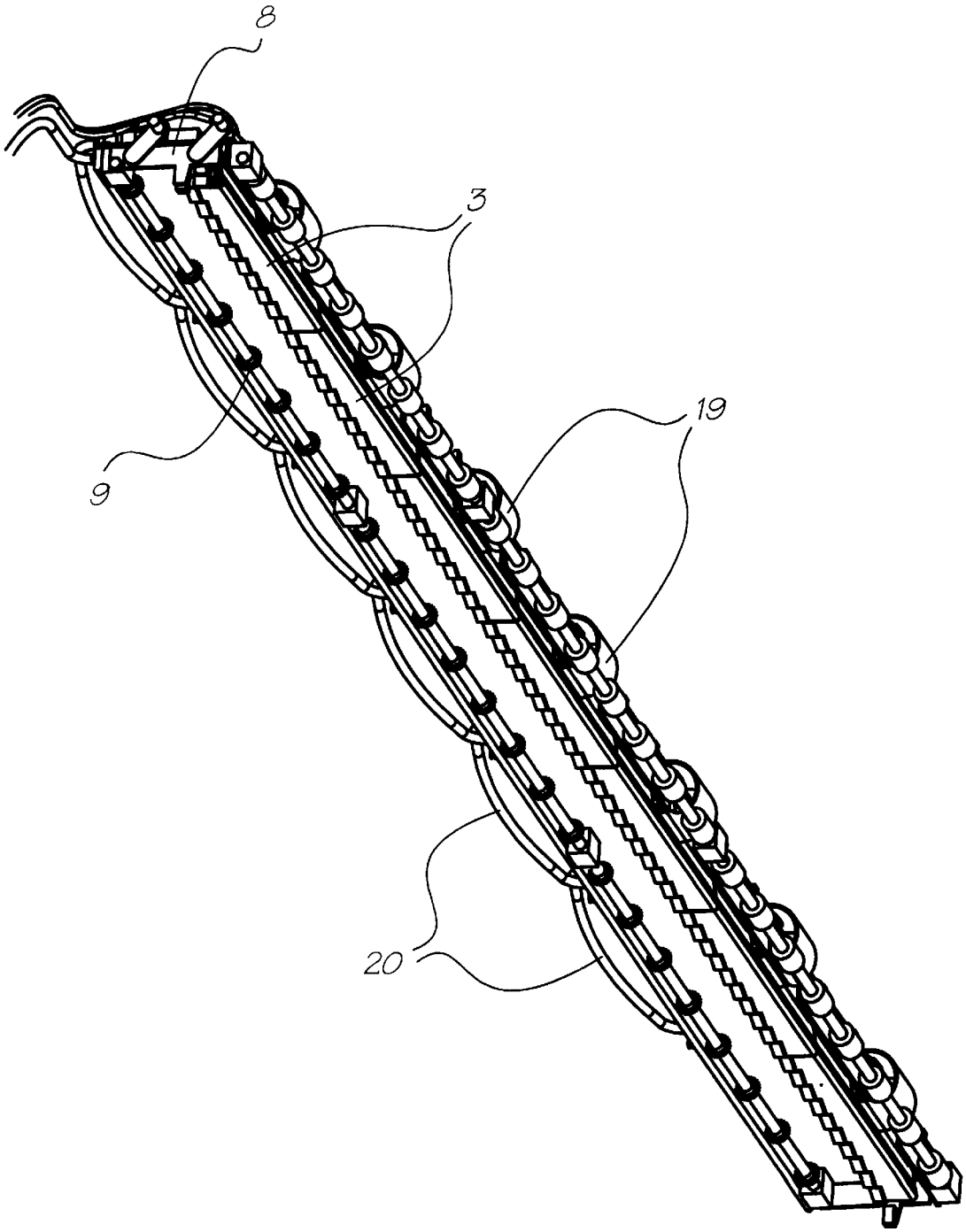
FIG. 18 is an underside perspective view of the printhead units of FIG. 17.

As shown in FIGS. 15, 16 and 17, ten printhead modules 1 are mounted to a modular printhead unit 3 denoted as a MEMJET printhead unit. Seven printhead units 3 are abutted together along a metal chassis (FIG. 17), to provide a 54 inch print width. The busbars 68 provide positive and negative current to the printhead units 3 via spade terminals.

Figure 20:
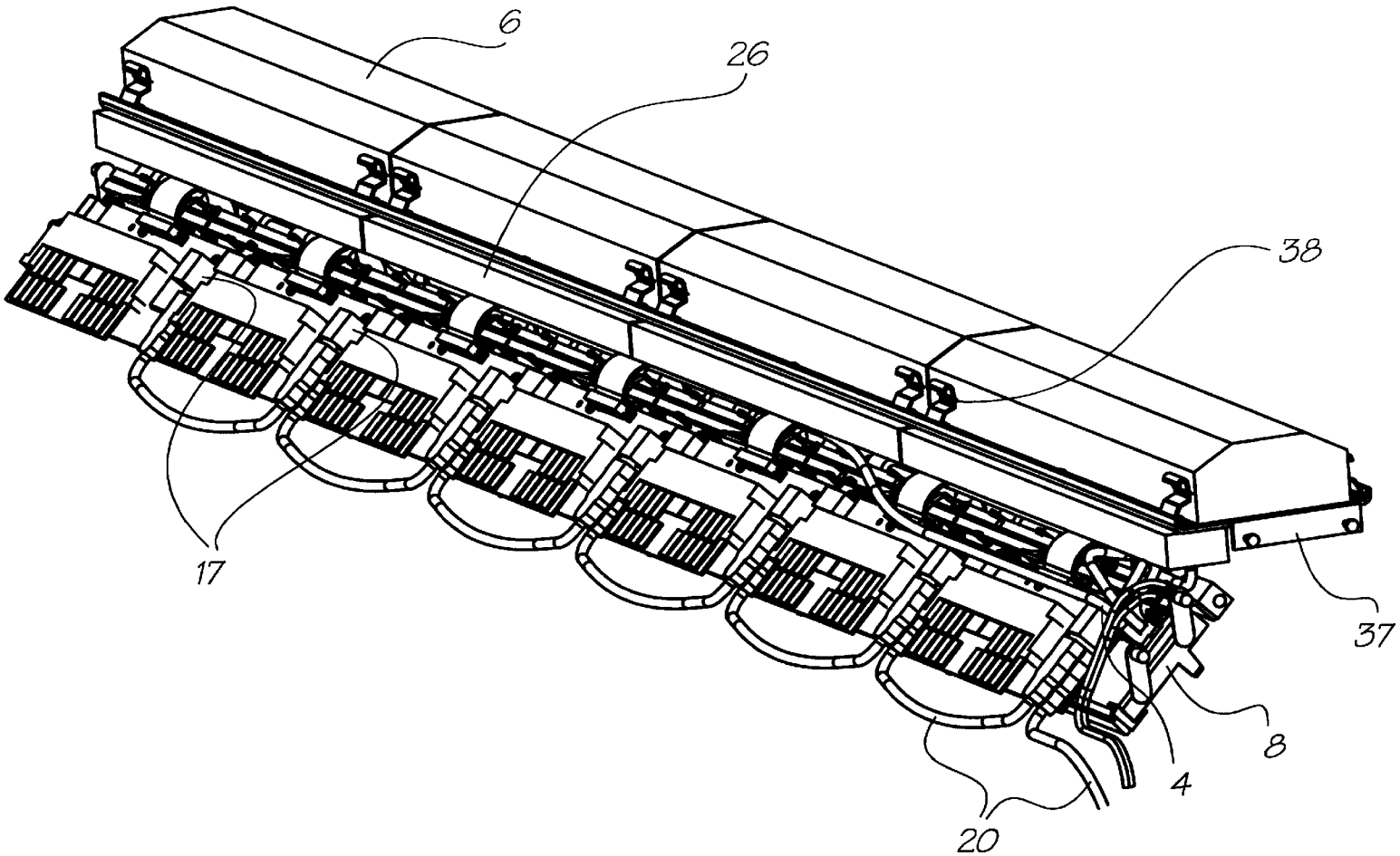
FIG. 20 is a perspective view of the printhead assembly together with the ink cartridges and ink reservoirs of the ink supply system.

It is possible to make wider format printers but 54 inches is a large standard roll size. The modular design of the printhead assembly allows individual printhead modules 1 to be accessed for replacement if necessary. It will be appreciated that this is far more convenient and cost effective than the replacement of an entire printhead assembly or even a single MEMJET printhead unit 3. As best shown in FIG. 20, the MEMJET printhead units 3 are daisy-chained together with ink connectors 4 so four colors can be transmitted to the entire length of the printhead assembly.

Other design configurations of the printhead assembly can be accommodated to provide printhead chips that supply fixer, infrared inks and/or specialist metallic inks together with the CMYK inks. Other design configurations include an air chamber and pump (not shown) added to the MEMJET printhead units 3 which supply positive pressure through the metal nozzle shield 5 to eliminate ingress of foreign particles. The ink cartridges 6 may also include a micro air filter (not shown) for use with a micro pump (not shown) and sprung capping assembly 7.

Figure 12:
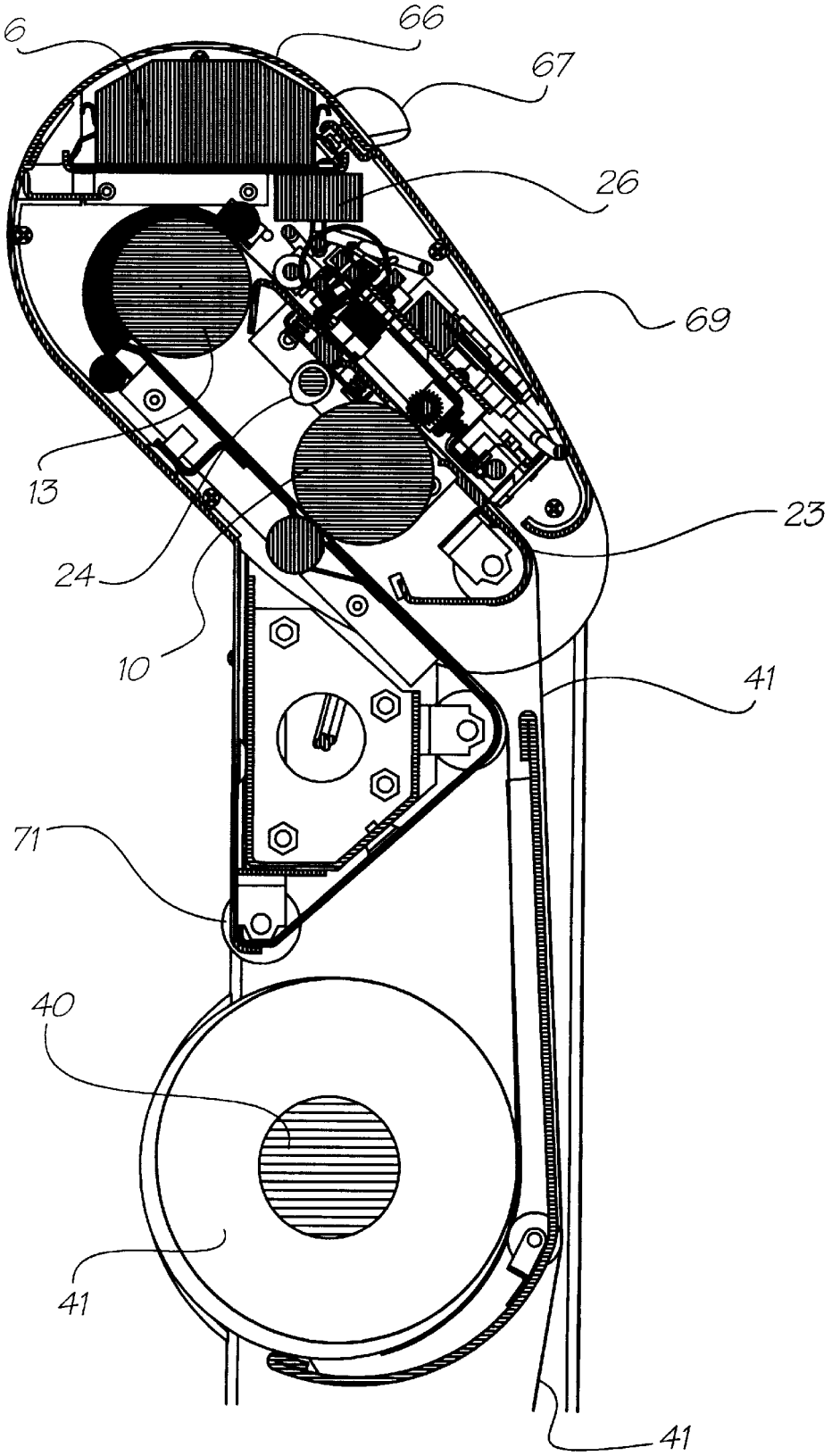
FIG. 12 is a partial cross sectional view of section A—A of FIG. 4.
Figure 13:
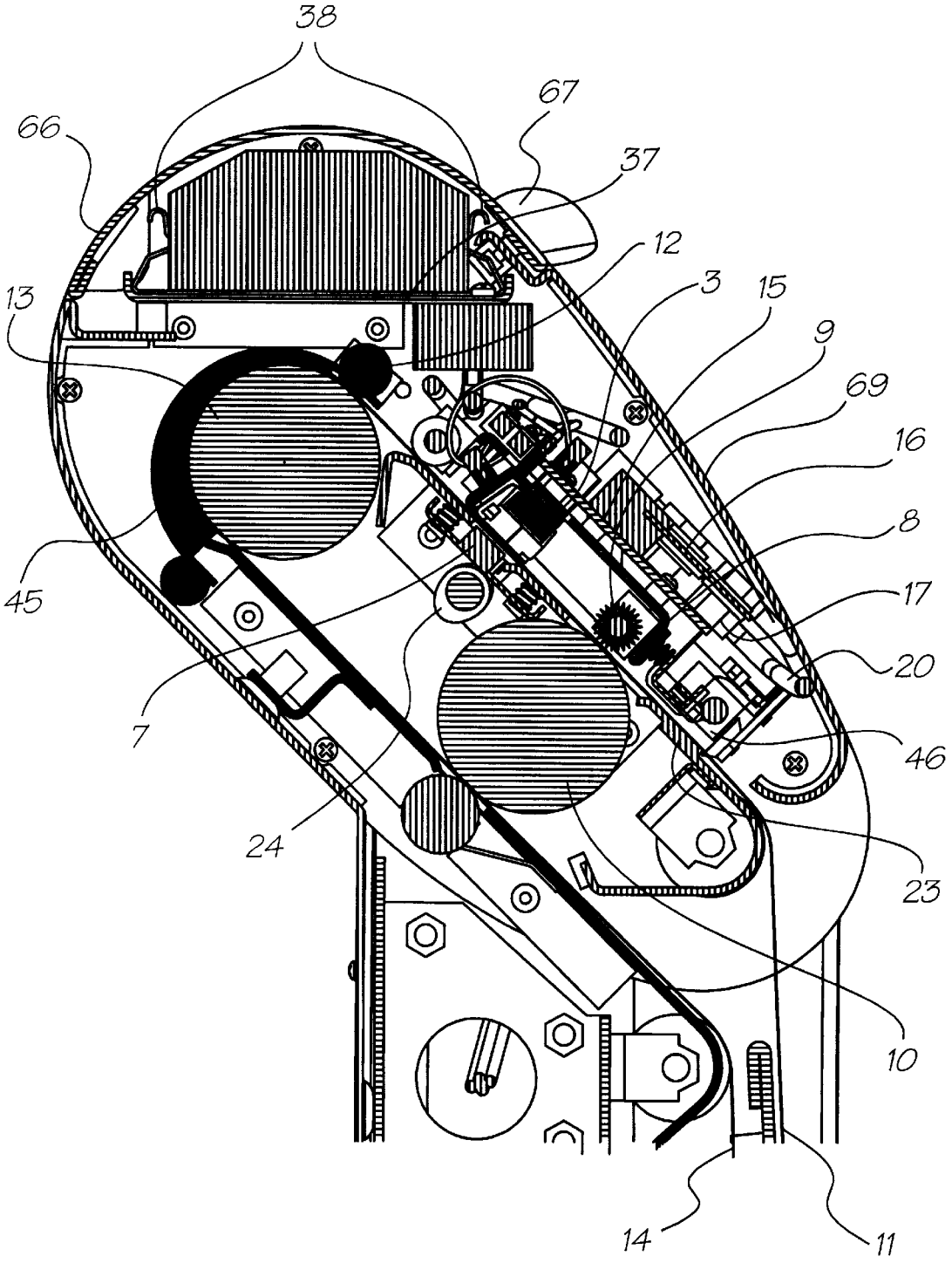
FIG. 13 is an enlarged portion of FIG. 12.
Figure 14:
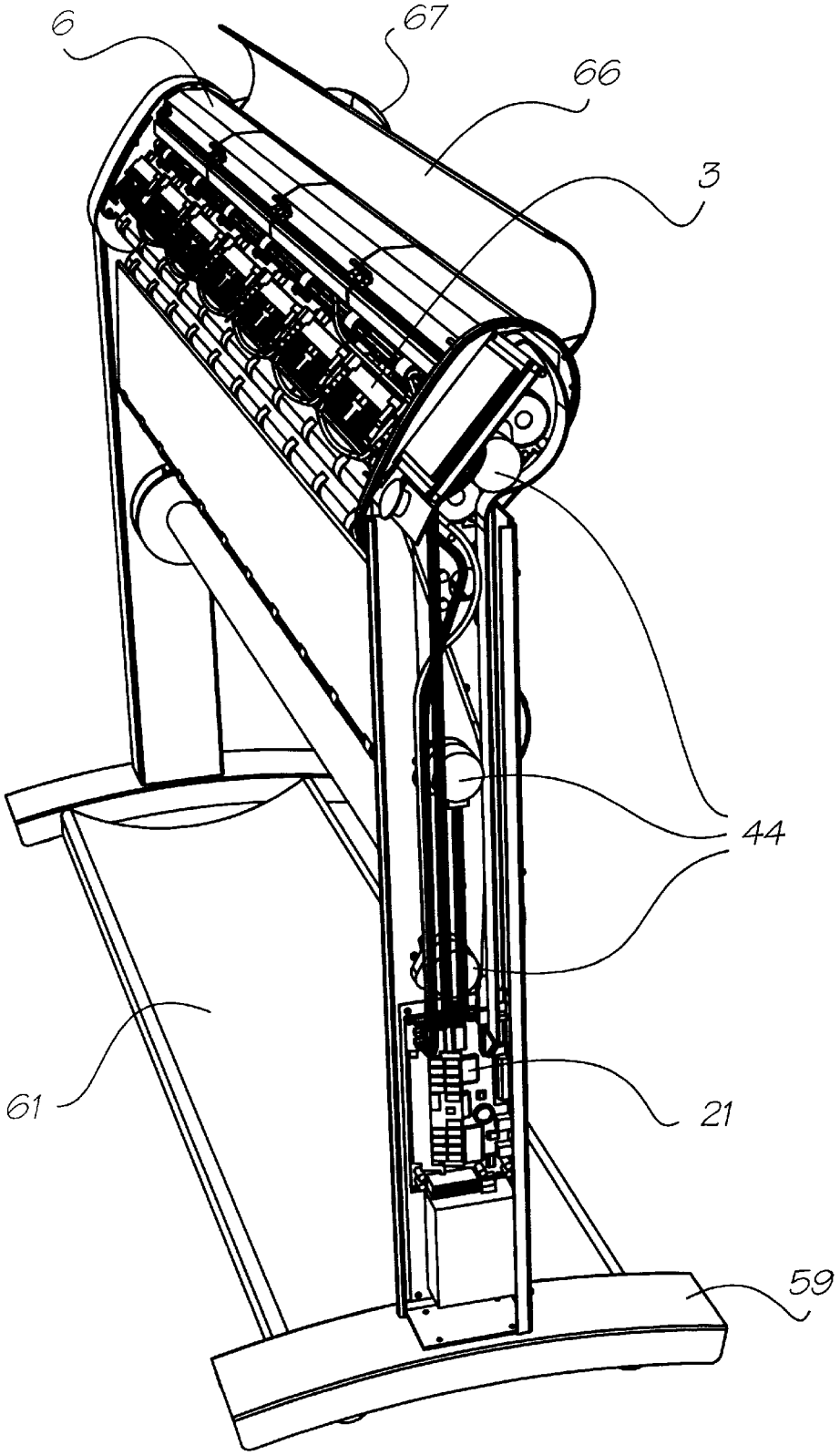
FIG. 14 is a perspective view showing the leg access cover removed.

The MEMJET printhead units 3 are heat staked/secured to a metal chassis 8 that carries exit spike wheels 9. As best shown in FIGS. 12 and 13, the spike wheels 9 oppose the primary media feed roller 10 to feed the media out of the printhead assembly at 14. Moveable pinch rollers 12 oppose the secondary media feed roller 13. Media is drawn in at 11 by the action of the primary roller 10 acting against a passive spring roller and feeding the media to the secondary roller 13. The chassis 8 is sprung and automatically moves the MEMJET printhead units 3 away from the metal platen 23 to accommodate thicker print media. The upper surface of the chassis 8 accommodates the control printed circuit boards (PCBs) 15 for each MEMJET printhead unit 3. Each PCB 15 has up to 512 megabytes of DRAM 16, a double USB 2 connector 17, a controller chip 18 and a printhead module interface connector. A ribbon cable 19 connects the PCBs 15 to the printhead modules 1 and each PCB 15 is daisy-chain connected via USB 2 cables 20 to a main PCB 21 located in a printer leg 43.

Figure 22:
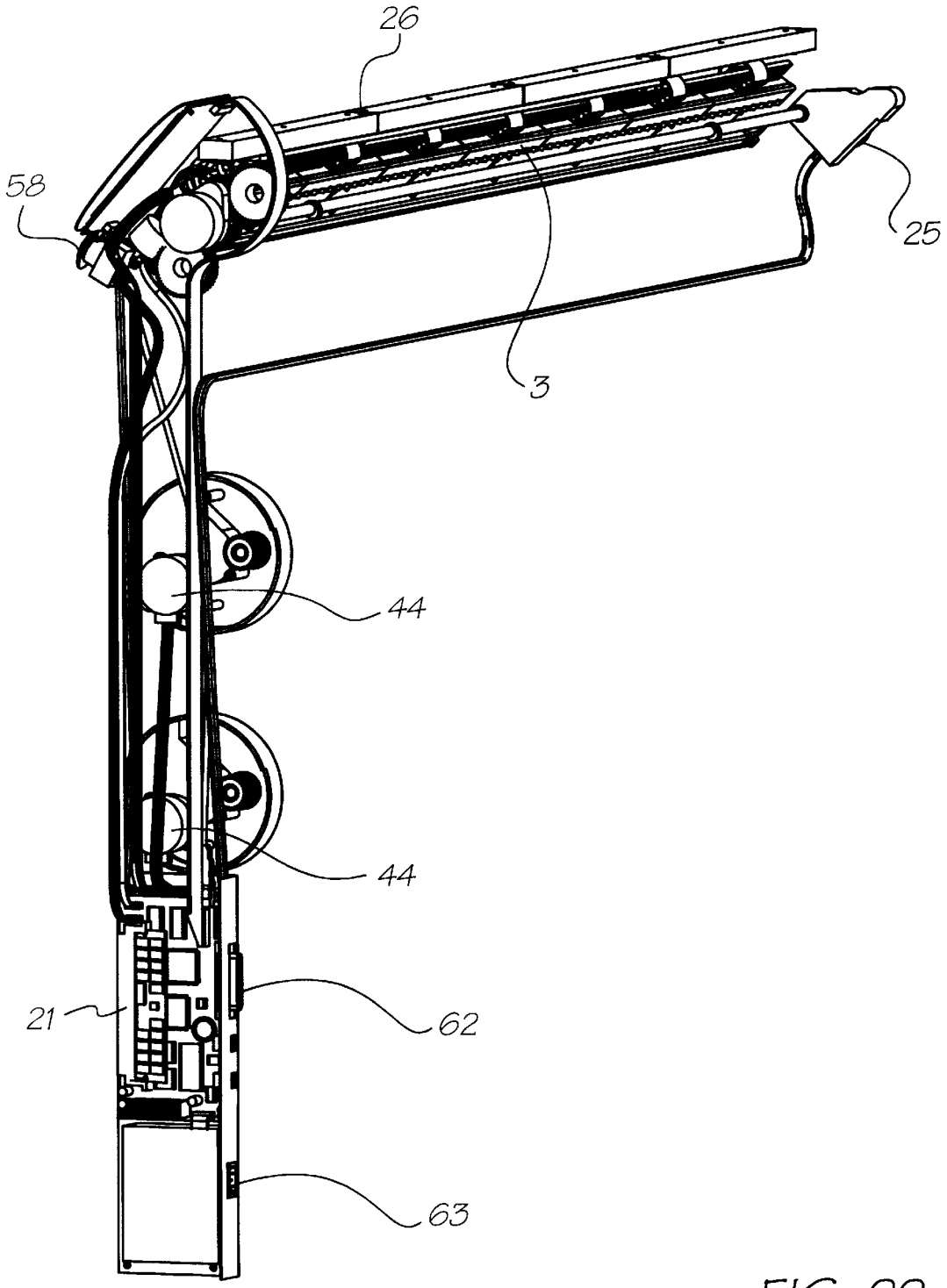
FIG. 22 is a rear perspective view of the printer electrical system.

The MEMJET chips 2 are capped by the capping assembly 7 when not in use. The capping assembly has a full width moving metal platen with an elastomeric (or similar) seal. The metal platen is spring mounted and moved into position by the action of powered cam shaft 24. The cam shaft 24 also moves the array of MEMJET printhead units 3 clear when loading media. The cam shaft is driven by the cam shaft motor and gearbox 25 as best shown in FIG. 22.

Figure 19:
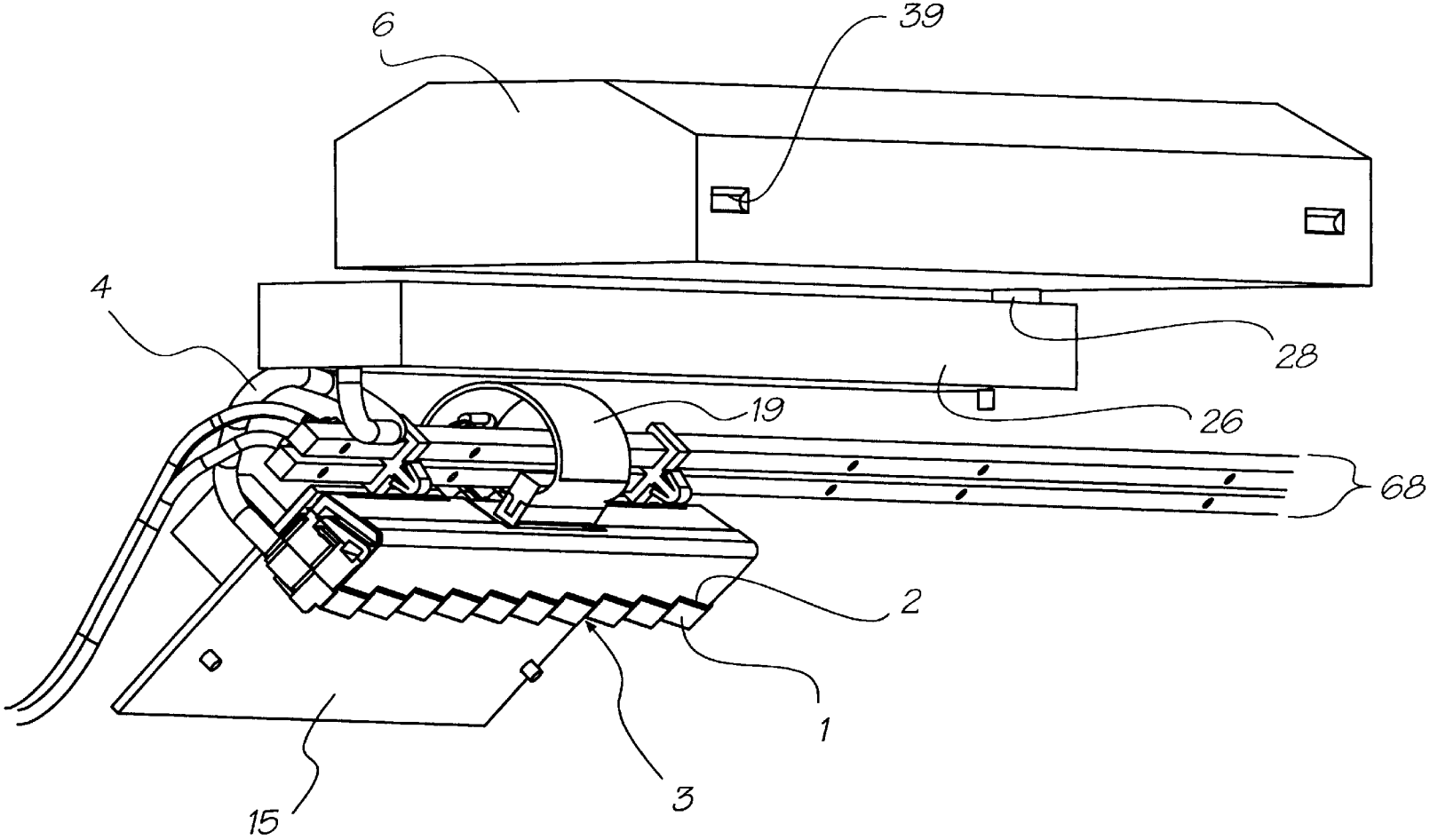
FIG. 19 is a perspective view of a single printhead unit and part of the printer ink supply system.

Referring to FIG. 19, the ink supply system is shown without the supporting metalwork. The entire array of MEMJET printhead units 3 is supplied with CMYK inks from four individual reservoirs 26 mounted above them. These reservoirs are supplied by replaceable ink cartridges 6 which sit at the top of the printer under the hinged lid 66. The cartridges 6 plugged directly into the ink reservoirs 26 via exit nozzle 28. The ink reservoirs 26 have sensors 27 that monitor ink levels.

Figure 21:
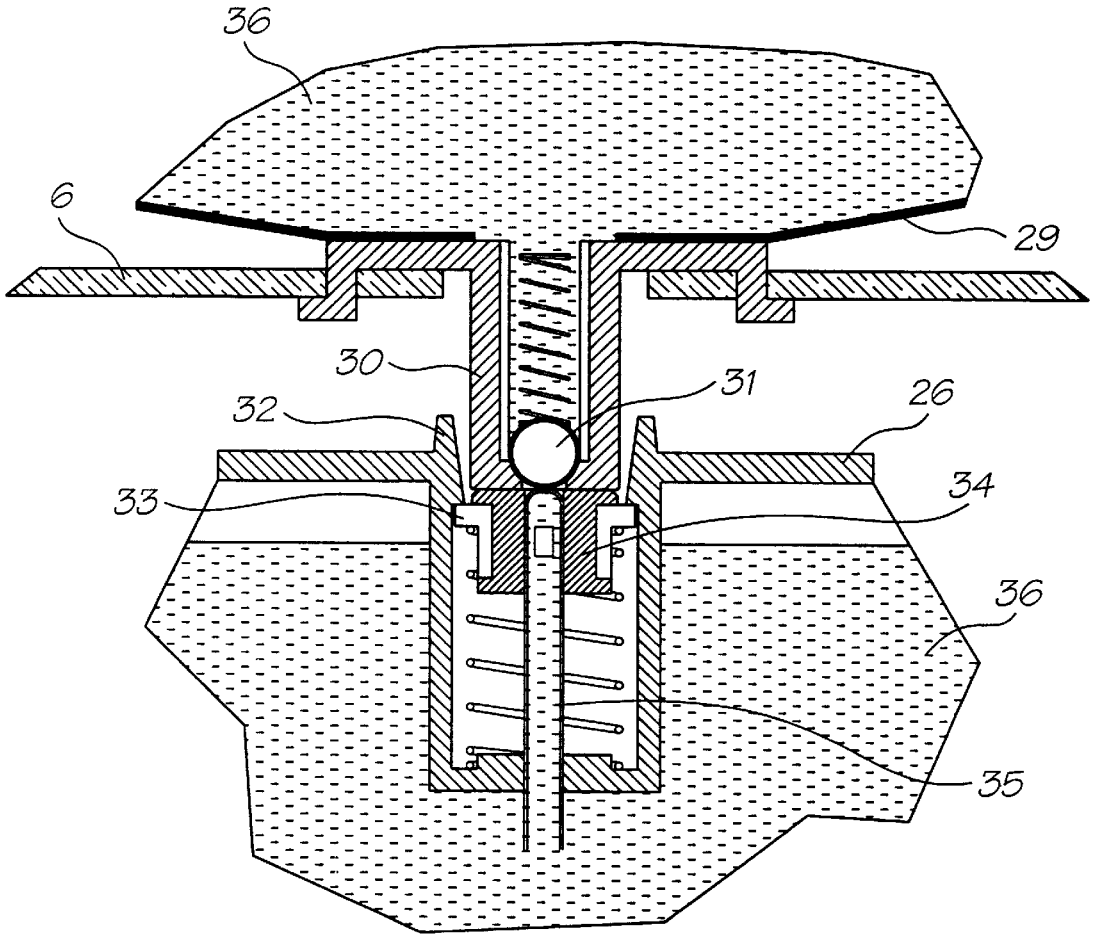
FIG. 21 is a partial cross sectional view showing the fluid communication between an ink cartridge and an ink reservoir.

FIG. 21 shows the ink cartridge exit nozzle 28 in detail. The cartridge 6 has a foil bladder 29 that is sealed around an ink outlet molding 30. A sprung rubber coated ball bearing 31 provides the seal for the ink cartridge 6. The exit nozzle 28 interfaces with the ink inlet assembly 32 of the reservoir 26. This consists of a sprung collar 33 with a hydrophobic seal 34 that moves over a hollow metal pin 35. As the collar 33 moves down the pin, 35 penetrates the ink outlet molding 30 and moves the ball bearing 31, allowing ink 36 to flow.

The ink cartridge 6 is a simple cardboard or thin plastic forming and, as best shown in FIGS. 13 and 20, the cartridges are snap locked to a metal trough 37 via retaining clips 38 and corresponding recesses 39. The ink reservoirs 26 are mounted to the underside of the trough 37. The cartridges 6 hold approximately 800 millilitres of ink and have a QA chip (not shown) which interfaces with the sensors 27 in the ink reservoirs 26.

Figure 23:
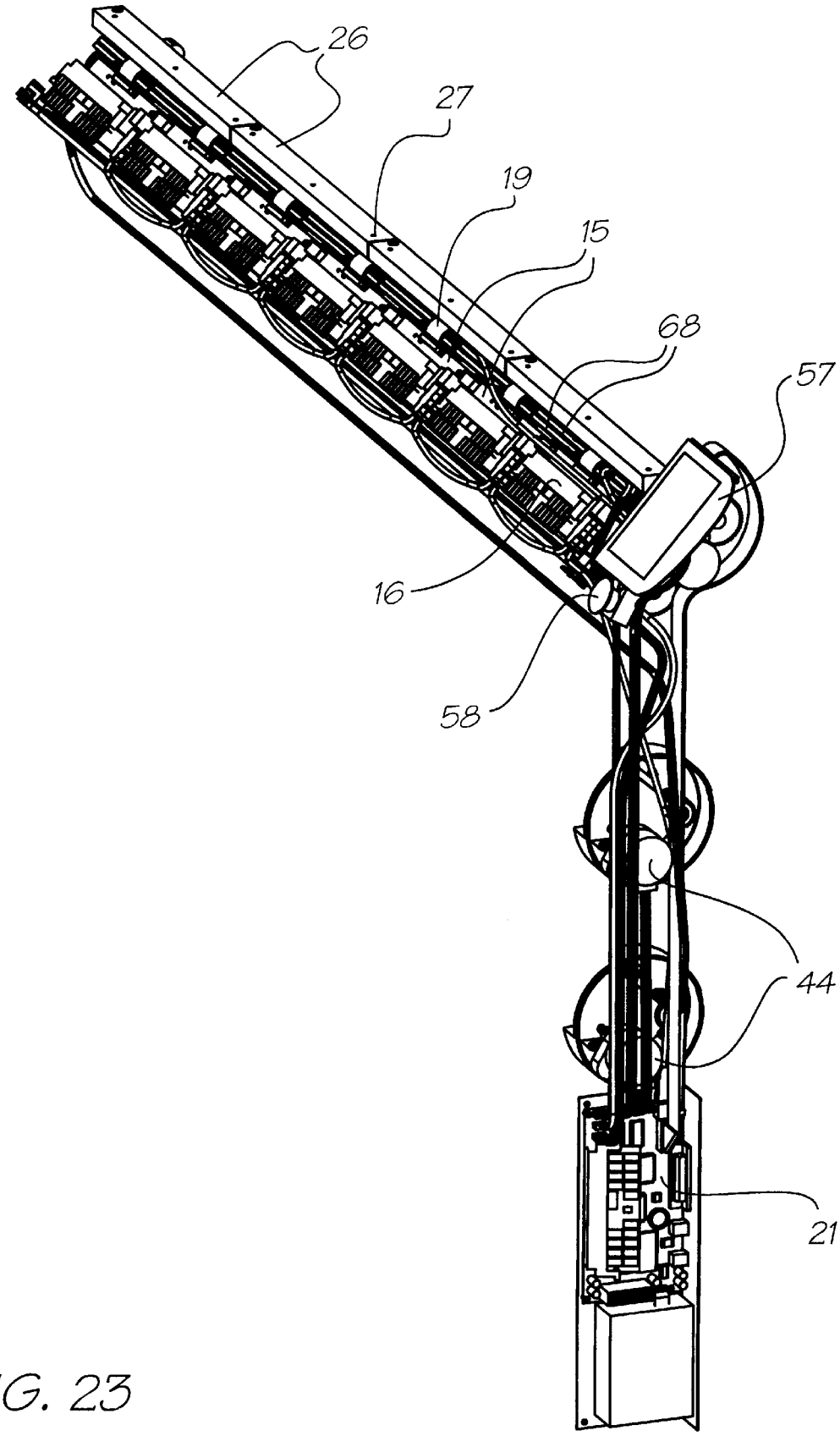
FIG. 23 is a front perspective view of the printer electrical system.
Figure 24:
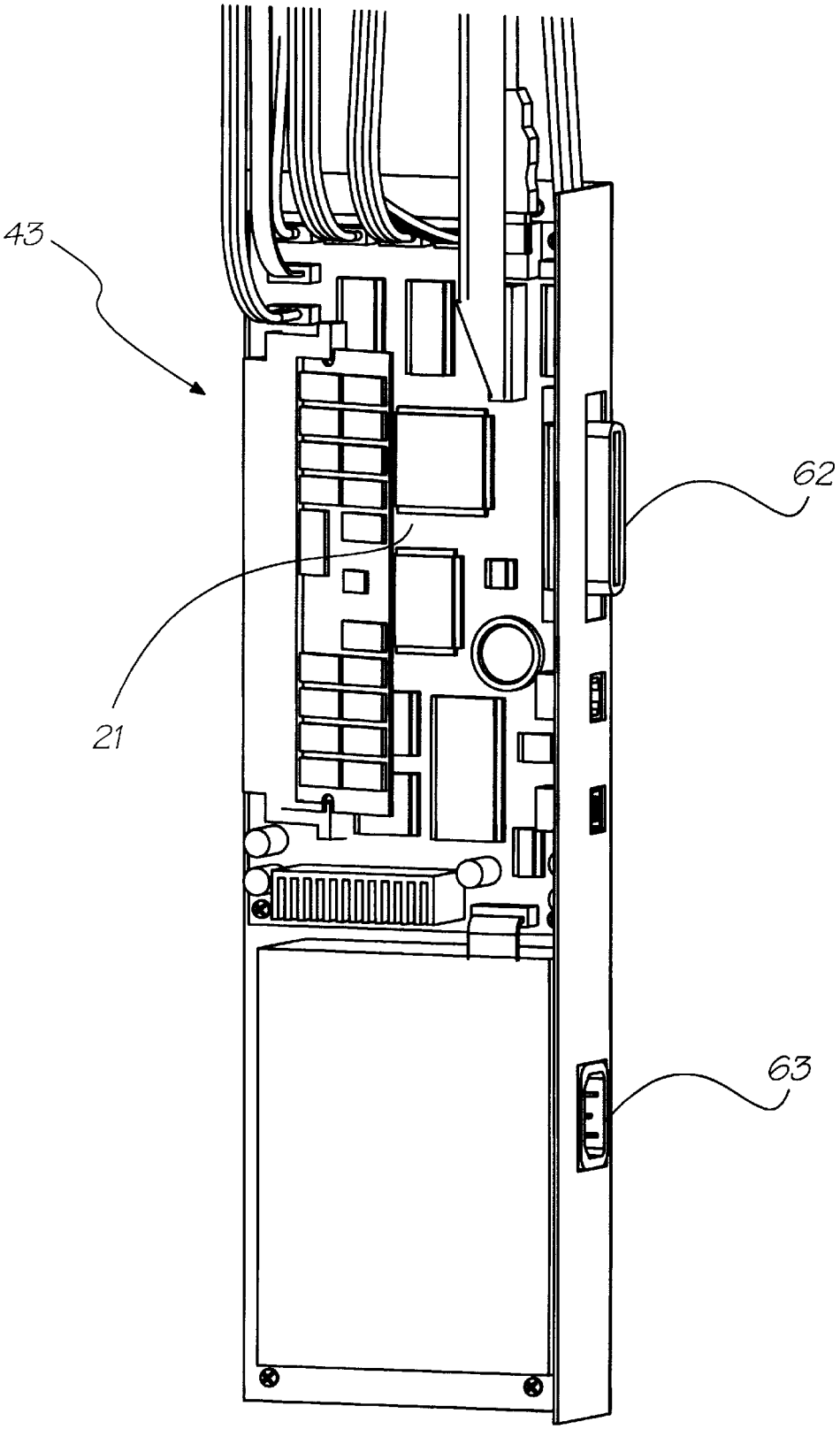
FIG. 24 is an enlarged portion of FIG. 22 showing the main printed circuit board.
Figure 26:
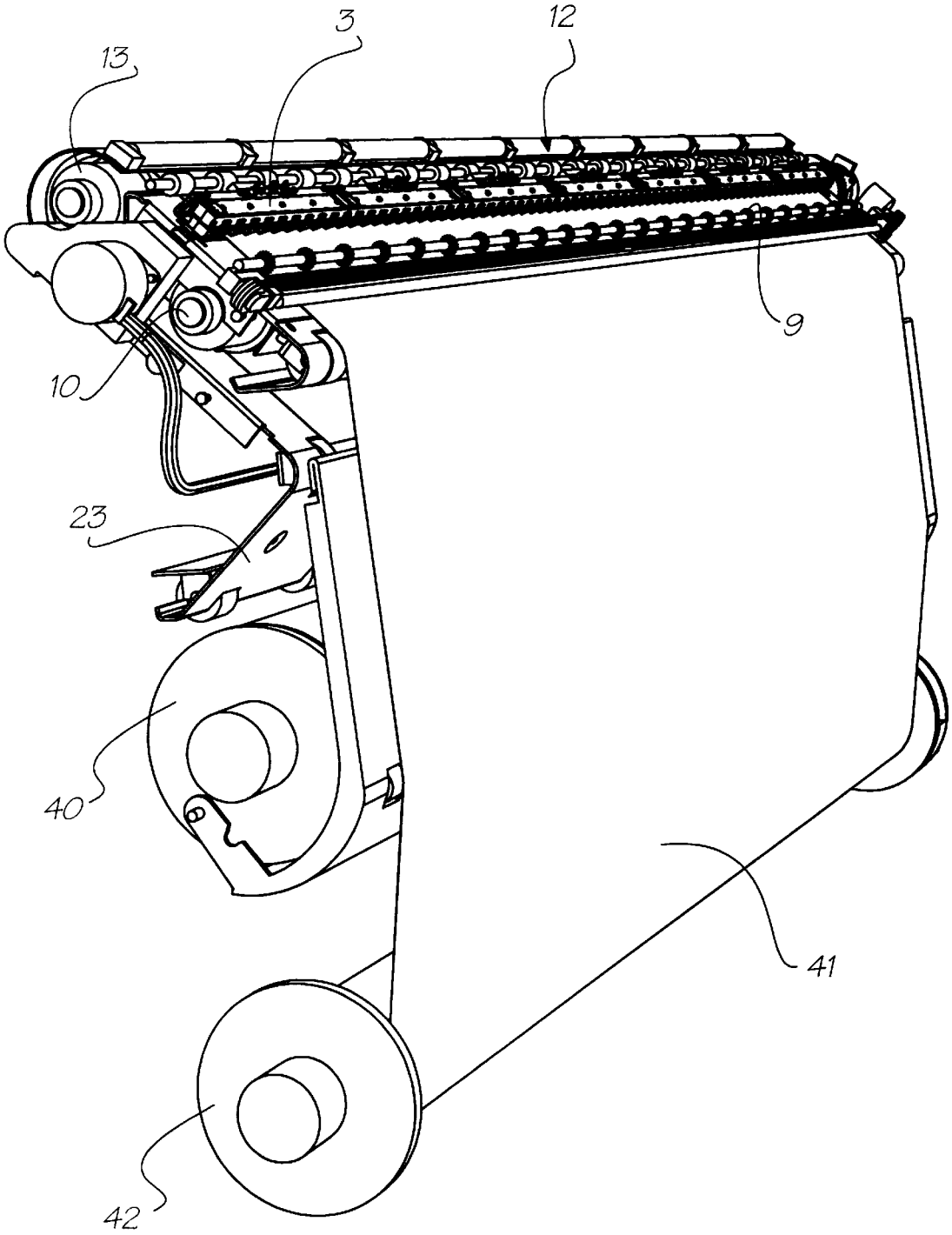
FIG. 26 is a top-side perspective view showing the media path through the printer.

FIGS. 1, 3, 12, 13, 26 and 27 show the media path through the Macroprint printer. The printer accommodates a standard 54 inch print media roll which is wound onto a plastic feed spool 40. The media 41 is fed from the feed spool 40 through the printhead assembly to a take up spool 42. The feed and take up spools 40 and 42 extend between the printer legs 43 and are driven by motor and gearbox assemblies 44 shown in FIGS. 22 and 23. Alternatively, a larger diameter roll of media may be used with Marcroprint because of the high operational print speeds. The larger roll may be on a separate support, such as a standard digital unwinder widely used in the print industry, and fed directly into Macroprint from the rear using alternative media entry rollers 71.

Figure 27:
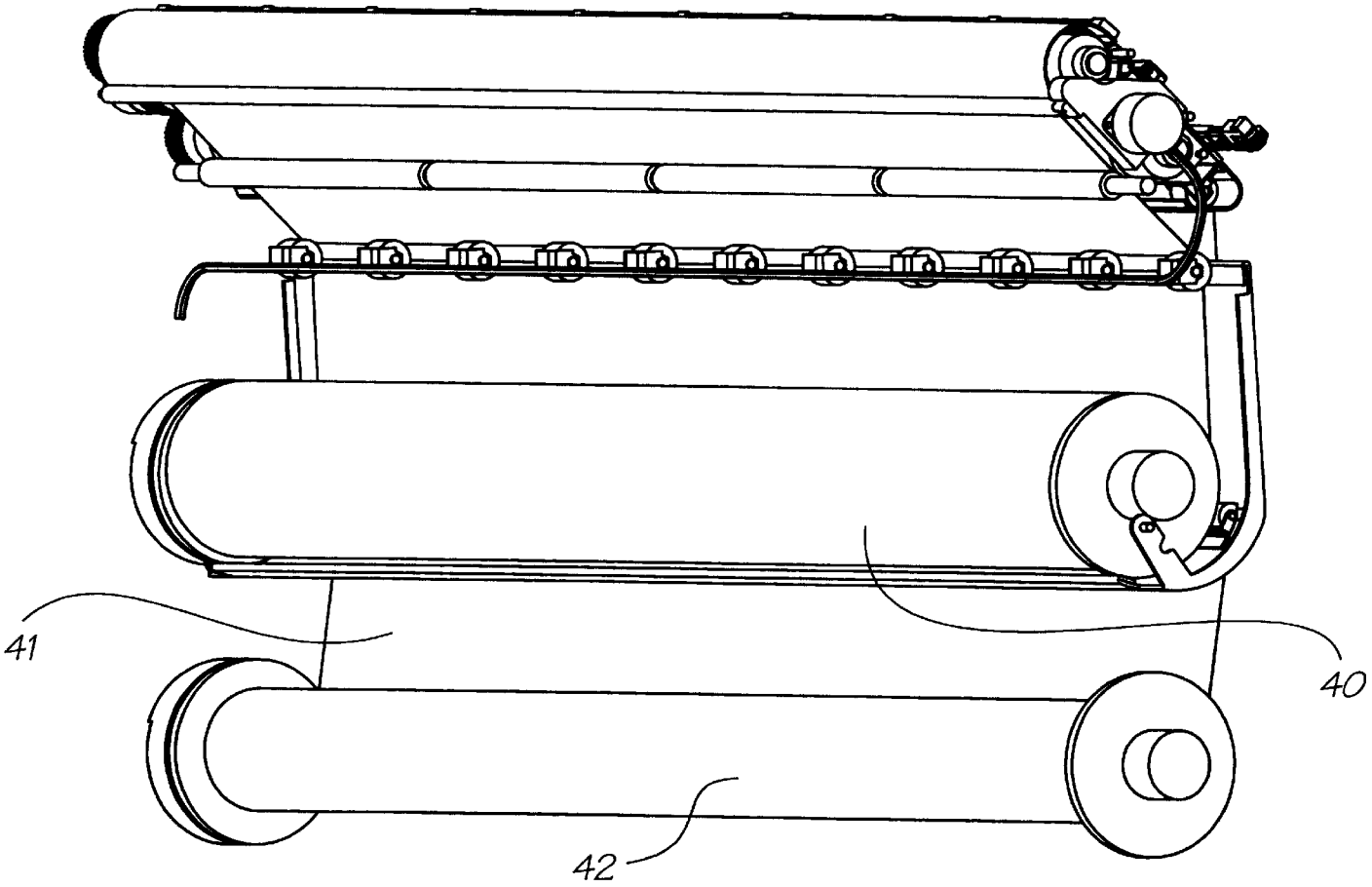
FIG. 27 is a rear perspective view showing the media path through the printer.

The media 41 is initially fed through a convolute path by the powered primary and secondary rollers 10 and 13. During loading of the media, the sheet is fed between the primary roller 10 and the spring passive roller (FIGS. 13 and 27). The primary roller 10 pushes the media 41 towards the secondary roller 13 while the pinch rollers 12 pivot away from the secondary roller 13 so that the media 41 can be guided around the curve of the roller by brushes 45. When the media 41 reaches the apex of the secondary roller 13, the pinch rollers 12 pivot down and provide positive grip for further feeding. The media 41 passes over the full width metal platen 23, between the MEMJET printhead units 3 and the capping assembly 7, and exits over two sets of passive rollers to the take-up reel 42.

Referring to FIGS. 25*a* and 25*b*, the printer is provided with a media cutter assembly. It consists of a traverser block and paper sensor 46 that runs on a shaft 47 under the action of belt drive 48. A pivoting metal arm 49 supports a rotating knife wheel 50 that cuts the media 41. The arm 49 is positioned up or down by use of the metal spring 51 contacting stops (not shown) on each cheek molding 54 of the printer. If the media 41 is inadvertently pulled, the cutter 50 and traverser block 46 pivots clear around the shaft 47 to prevent damage. Sensor leads 52 from the image sensor 46 run in a metal U channel 53 and connect to the main PCB 21 in the printer leg. A sprung tensioner device 55 is mounted on the left side of the printer to complete the cutter assembly.

The 1600 dpi high resolution of the Macroprint allows economy of ink usage and image quality to be superior to any contemporary products. The MEMJET printhead units 3 use 1 picoliter of ink per 1600 dpi nozzle as opposed to a current average of 21 picoliters per 600 dpi nozzle. The ratio of ink usage of a current 600 dpi nozzle compared to a MEMJET 1600 dpi nozzle is 2.95:1.

The Macroprint printer can print an A1 sized sheet of media at 1600 dpi photo quality in 2 seconds. This makes it about 600 times faster than the top of the range HP 3500 CP printer. The 54 inch wide by 150 foot length standard roll of paper can be printed in 2.4 minutes compared to 24 hours for the HP 3500 CP printer. It is theoretically possible to produce a thermal bubble inkjet printhead that extends the entire 54 inch width of a standard roll to achieve the same print speeds, however, its power consumption would be approximately 40 times greater than Macroprint. Accordingly, it would require an additional active cooling system to dissipate heat. Even with most forced heat exchange systems, the nozzle packing density would not be high enough to provide a wide format pagewidth printhead of a practical size. Because of these impediments, pagewidth thermal bubble inkjet printers have not become a commercial reality. By utilising thermal bend actuators in the MEMS printhead chips and modularising the printhead assembly design, the Macroprint printer provides practical wide format printing in a real commercial sense.

The present invention has been described herein with reference a specific example which should not be seen as limiting or restrictive on the broad inventive concept.

What is claimed is:

1. A pagewidth wide format inkjet printer that comprises a printhead assembly having an elongate pagewidth array of micro electro-mechanical inkjet nozzles, chambers and thermal bend actuators;

wherein the array extends at least 36 inches (914 mm) in length; and the printhead assembly is configured so that power consumed by the printhead assembly is sufficiently low to cause a majority of heat generated by the thermal bend actuators to be dissipated by ink ejected through the nozzles.

2. A pagewidth inkjet printer according to claim 1, wherein the printhead assembly has a plurality of inkjet printhead modules arranged end to end to form the array, each module having a printhead chip in which the nozzles, chambers and thermal bend actuators are formed such that the surface area of the chip required for each nozzle is less than 0.5 $mm^2$.

3. A pagewidth inkjet printer according to claim 2, wherein the surface area of the chip required for each nozzle is less than 0.1 $mm^2$.

4. A pagewidth inkjet printer according to claim 3, wherein the surface area of the chip required for each nozzle is less than 0.02 $mm^2$.

* * * * *